US008294737B2

(12) United States Patent
Tanikame et al.

(10) Patent No.: US 8,294,737 B2
(45) **Date of Patent: *Oct. 23, 2012**

(54) DISPLAY APPARATUS AND DISPLAY-APPARATUS DRIVING METHOD

(75) Inventors: Takao Tanikame, Kanagawa (JP); Seiichiro Jinta, Aichi (JP)

(73) Assignee: Sony Corporation, Tokyo (JP)

( * ) Notice: Subject to any disclaimer, the term of this patent is extended or adjusted under 35 U.S.C. 154(b) by 839 days.

This patent is subject to a terminal disclaimer.

(21) Appl. No.: 12/385,689

(22) Filed: Apr. 16, 2009

(65) Prior Publication Data

US 2009/0273617 A1 Nov. 5, 2009

(30) Foreign Application Priority Data

May 1, 2008 (JP) ..... 2008-119838

(51) Int. Cl.
*G09G 5/10* (2006.01)

(52) U.S. Cl. ..... 345/690; 345/211

(58) Field of Classification Search ..... 345/211, 345/76, 690
See application file for complete search history.

(56) References Cited

U.S. PATENT DOCUMENTS

| | | | | |
|---|---|---|---|---|
| 7,414,599 | B2 | 8/2008 | Chung et al. | |
| 7,898,509 | B2 * | 3/2011 | Iida et al. | 345/76 |
| 7,956,829 | B2 * | 6/2011 | Iida et al. | 345/80 |
| 8,138,999 | B2 * | 3/2012 | Yamamoto et al. | 345/76 |
| 2009/0273547 | A1 * | 11/2009 | Tanikame et al. | 345/76 |
| 2009/0273590 | A1 * | 11/2009 | Tanikame et al. | 345/211 |

FOREIGN PATENT DOCUMENTS

| | | |
|---|---|---|
| JP | 2005-031630 | 2/2005 |
| JP | 2009-237558 A | 10/2009 |

OTHER PUBLICATIONS

Japanese Office Action issued Jun. 26, 2012 for corresponding Japanese Application No. 2008-119838.

* cited by examiner

*Primary Examiner* — Quan-Zhen Wang
*Assistant Examiner* — Yuk Chow
(74) *Attorney, Agent, or Firm* — Rader Fishman & Grauer, PLLC

(57) ABSTRACT

Disclosed herein is a driving method for driving a, display apparatus, the display apparatus including: N×M light emitting units; M scan lines; N data lines; a driving circuit provided for each of the light emitting units to serve as a circuit having a signal writing transistor, a device driving transistor, a capacitor and a first switch circuit; and a light emitting device.

18 Claims, 11 Drawing Sheets

[TP-1]

[TP0]

[TP1]

[TP2]

[TP3]

DISPLAY APPARATUS AND DISPLAY-APPARATUS DRIVING METHOD

BACKGROUND OF THE INVENTION

1. Field of the Invention

In general, the present invention relates to a display apparatus and a driving method for driving the display apparatus. More particularly, the present invention relates to a display apparatus employing light emitting units, which each have a light emitting device and a driving circuit for driving the light emitting device, and relates to a driving method for driving the display apparatus.

2. Description of the Related Art

As already known in general, there is a light emitting unit having a light emitting device and a driving circuit for driving the light emitting device which emits light when a driving current generated by the driving circuit flows through the device. A typical example of the light emitting device is an organic EL (Electro Luminescence) light emitting device. In addition, a display apparatus employing the light emitting units is also already commonly known. The luminance of light emitted by the light emitting unit is determined by the magnitude of the driving current which is controlled by the driving circuit employed in the light emitting unit to flow through the light emitting device. A typical example of such a display apparatus is an organic EL display apparatus which employs organic EL light emitting devices.

In addition, in the same way as a liquid-crystal display apparatus, the display apparatus employing the light emitting units adopts one of commonly known driving methods such as a simple matrix method and an active matrix method. In comparison with the simple matrix method, the active matrix method has a demerit that the active matrix method entails a complicated configuration of the driving circuit. However, the active matrix method offers a variety of merits such as a capability of increasing the luminance of light emitted by the light emitting device.

As already known, there are a variety of driving circuits which each employ transistors and a capacitor. Such a driving circuit serves as a circuit for driving the light emitting device included in the same light emitting unit as the driving circuit. For example, Japanese Patent Laid-open No. 2005-31630 discloses an organic EL display apparatus employing light emitting units, which each, have an organic EL light emitting device and a driving circuit for driving the organic EL light emitting device, and discloses a driving method for driving the organic EL display apparatus. The driving circuit employs six transistors and one capacitor. In the following description, the driving circuit employing six transistors and one capacitor is referred to as a 6Tr/1C driving circuit. FIG. 7 is a diagram showing an equivalent circuit of the 6Tr/1C driving circuit included in a light emitting unit located at the intersection of an mth matrix row and an nth matrix column in a two-dimensional matrix in which N×M light emitting units employed in a display apparatus are laid out to form a two-dimensional matrix composed of N columns and M rows. It is to be noted that the light emitting units are sequentially scanned by a scan circuit 101 in row units on a row-after-row basis.

The 6Tr/1C driving circuit included in the light emitting unit employs a signal writing transistor $TR_W$, a device driving transistor $TR_D$ and a capacitor $C_1$ in addition to a first transistor $TR_1$, a second transistor $TR_2$, a third transistor $TR_3$ and a fourth transistor $TR_4$.

A specific one of the source and drain areas of the signal writing transistor $TR_W$ is connected to a data line $DTL_n$ conveying a video signal $V_{Sig}$ whereas the gate electrode of the signal writing transistor $TR_W$ is connected to a scan line $SCL_m$ conveying a scan signal. A specific one of the source and drain areas of the device driving transistor $TR_D$ is connected to the other one of the source and drain areas of the signal writing transistor $TR_W$ through a first node $ND_1$. A specific one of the terminals of the capacitor $C_1$ is connected to a first power-supply line $PS_1$ to which a reference voltage is applied. In the typical light emitting unit shown in the diagram of FIG. 7, the reference voltage is a reference voltage $V_{CC}$ to be described layer. The other one of the terminals of the capacitor $C_1$ is connected to the gate electrode of the device driving transistor $TR_D$ through a second node $ND_2$. The scan line $SCL_m$ is connected to the scan circuit 101 whereas the data line $DTL_n$ is connected to a signal outputting circuit 102.

A specific one of the source and drain areas of the first transistor $TR_1$ is connected to the second node $ND_2$ whereas the other one of the source and drain areas of the first transistor $TR_1$ is connected to the other one of the source and drain areas of the device driving transistor $TR_D$. The first transistor $TR_1$ serves as a first switch circuit connected between the second node $ND_2$ and the other one of the source and drain areas of the device driving transistor $TR_D$.

A specific one of the source and drain areas of the second transistor $TR_2$ is connected to a third power-supply line $PS_3$ to which a predetermined initialization voltage $V_{Ini}$ for initializing an electric potential appearing on the second node $ND_2$ is applied. The initialization voltage $V_{Ini}$ is typically −4 volts. The other one of the source and drain areas of the second transistor $TR_2$ is connected to the second node $ND_2$. The second transistor $TR_2$ serves as a second switch circuit connected between the second node $ND_2$ and the third power-supply line $PS_3$ to which the predetermined initialization voltage $V_{Ini}$ for initializing an electric potential appearing on the second node $ND_2$ is applied.

A specific one of the source and drain areas of the third transistor $TR_3$ is connected to the first power-supply line $PS_1$ to which the predetermined reference voltage $V_{CC}$ of typically 10 volts is applied. The other one of the source and drain areas of the third transistor $TR_3$ is connected to the first node $ND_1$. The third transistor $TR_3$ serves as a third switch circuit connected between the first node $ND_1$ and the first power-supply line $PS_1$ to which the predetermined reference voltage $V_{CC}$ is applied.

A specific one of the source and drain areas of the fourth transistor $TR_4$ is connected to the other one of the source and drain areas of the device driving transistor $TR_D$ whereas the other one of the source and drain areas of the fourth transistor $TR_4$ is connected to a specific one of the terminals of a light emitting device ELP. The specific one of the terminals of the light emitting device ELP is the anode electrode of the light emitting device ELP. The fourth transistor $TR_4$ serves as a fourth switch circuit connected between the other one of the source and drain areas of the device driving transistor $TR_D$ and the specific terminal (or the anode electrode) of the light emitting device ELP.

The gate electrodes of the signal writing transistor $TR_W$ and the first transistor $TR_1$ are connected to the scan line $SCL_m$ whereas the gate electrode of the second transistor $TR_2$ is connected to a scan line $SCL_{m-1}$ provided for a matrix row right above a matrix row associated with the scan line $SCL_m$. The gate electrodes of the third transistor $TR_3$ and the fourth transistor $TR_4$ are connected to a third/fourth-transistor control line $CL_m$.

Each of the signal writing transistor $TR_W$, the device driving transistor $TR_D$, the first transistor $TR_1$, the second transistor $TR_2$, the third transistor $TR_3$ and the fourth transistor $TR_4$ is a TFT (Thin Film Transistor) of a p-channel type. The light emitting device ELP is provided typically on an interlayer insulation layer which is created to cover the driving circuit. The anode electrode of the light emitting device ELP is connected to the other one of the source and drain areas of the fourth transistor $TR_4$ whereas the cathode electrode of the light emitting device ELP is connected to a second power-supply line $PS_2$ for supplying a cathode voltage $V_{Cat}$ of typically −10 volts to the cathode electrode. Reference notation $C_{EL}$ denotes the parasitic capacitance of the light emitting device ELP.

It is impossible to prevent the threshold voltage of a TFT from varying to a certain degree from transistor to transistor due to variations in manufacturing process. Variations of the threshold voltage of the device driving transistor $TR_D$ cause variations of the magnitude of a driving current flowing through the light emitting device ELP. If the magnitude of the driving current flowing through the light emitting device ELP varies from a light emitting unit to another even if the same video signal $V_{Sig}$ is supplied to the light emitting units, the uniformity of the luminance of the display apparatus deteriorates. It is thus necessary to prevent the magnitude of the driving current flowing through the light emitting device ELP from being affected by variations of the threshold voltage of the device driving transistor $TR_D$. As will be described later, the light emitting device ELP is driven in such a way that the luminance of light emitted by the light emitting device ELP is not affected by variations of the threshold voltage of the device driving transistor $TR_D$.

By referring to diagrams of FIGS. 8A and 8B, the following description explains a driving method for driving an light emitting device ELP employed in a light emitting unit located at the intersection of an mth matrix row and an nth matrix column of a two-dimensional matrix in which N×M light emitting units employed in a display apparatus are laid out to form a two-dimensional matrix composed of N columns and M rows. FIG. 8A is a model timing diagram showing timing charts of signals appearing on the scan line $SCL_{m-1}$, the scan line $SCL_m$ and the third/fourth-transistor control line $CL_m$. On the other hand, FIG. 8B, and FIGS. 8C and 8D are model circuit diagrams showing the turned-on and turned-off states of the signal writing transistor $TR_W$, the device driving transistor $TR_D$, the first transistor $TR_1$, the second transistor $TR_2$, the third transistor $TR_3$ and the fourth transistor $TR_4$ which are employed in the 6Tr/1C driving circuit. For the sake of convenience, in the following description, the scan period in which the scan line $SCL_{m-1}$ is used for scanning the light emitting units provided on a matrix row associated with the scan line $SCL_{m-1}$ is referred to as the (m−1)th horizontal scan period whereas the scan period in which the scan line $SCL_m$ is scanned is referred to as the mth horizontal scan period.

As shown in the timing diagram of FIG. 8A, during the (m−1)th horizontal scan period, a second-node electric-potential initialization process is carried out. The second-node electric-potential initialization process is explained in detail by referring to the circuit diagram of FIG. 8B as follows. At the beginning of the (m−1)th horizontal scan period, an electric potential appearing on the scan line $SCL_{m-1}$ is changed from a high level to a low level but an electric potential appearing on the third/fourth-transistor control line $CL_m$ is conversely changed from a low level to a high level. It is to be noted that, at that time, an electric potential appearing on the scan line $SCL_m$ is sustained at a high level. Thus, during the (m−1)th horizontal scan period, each of the signal writing transistor $TR_W$, the first transistor $TR_1$, the third transistor $TR_3$ and the fourth transistor $TR_4$ is put in a turned-off state whereas the second transistor $TR_2$ is put in a turned-on state.

In these states, the initialization voltage $V_{Ini}$ for initializing the second node $ND_2$ is applied to the second node $ND_2$ by way of the second transistor $TR_2$ which has been set in a turned-on state. Thus, during this period, the second-node electric-potential initialization process is carried out to initialize the electric potential appearing on the second node $ND_2$ to the initialization voltage $V_{Ini}$ which appears on the third power-supply line $PS_3$.

Then, as shown in the timing diagram of FIG. 8A, during the mth horizontal scan period, the electric potential appearing on the scan line $SCL_m$ is changed from a high level to a low level in order to put the signal writing transistor $TR_W$ in a turned-on state so that the video signal $V_{Sig}$ appearing on the data line $DTL_n$ is written into the first node $ND_1$ by way of the signal writing transistor $TR_W$. During this mth horizontal scan period, a threshold-voltage cancelling process is also carried out at the same time in order to cancel the effect of variations of the threshold voltage of the device driving transistor $TR_D$. To put it concretely, the second node $ND_2$ is electrically connected to the other one of the source and drain areas of the device driving transistor $TR_D$ through the first transistor $TR_1$. When the electric potential appearing on the scan line $SCL_m$ is changed from a high level to a low level in order to put the signal writing transistor $TR_W$ in a turned-on state, the video signal $V_{Sig}$ appearing on the data line $DTL_n$ is written into the first node $ND_1$ by way of the signal writing transistor $TR_W$. As a result, the electric potential appearing on the second node $ND_2$ rises to a level obtained by subtracting the threshold voltage $V_{th}$ of the device driving transistor $TR_D$ from the video signal $V_{Sig}$.

The processes described above are explained in detail by referring to the diagrams of FIGS. 8A and 8C as follows. At the beginning of the mth horizontal scan period, the electric potential appearing on the scan line $SCL_{m-1}$ is changed from a low level to a high level but the electric potential appearing on the scan line $SCL_m$ is conversely changed from a high level to a low level. It is to be noted that, at that time, the electric potential appearing on the third/fourth-transistor control line $CL_m$ is sustained at the high level. Thus, during the mth horizontal scan period, each of the signal writing transistor $TR_W$ and the first transistor $TR_1$ is put in a turned-on state whereas each of the second transistor $TR_2$, the third transistor $TR_3$ and the fourth transistor $TR_4$ is conversely put in a turned-off state.

The second node $ND_2$ is electrically connected to the other one of the source and drain areas of the device driving transistor $TR_D$ through the first transistor $TR_1$ which has been put in a turned-on state. When the electric potential appearing on the scan line $SCL_m$ is changed from a high level to a low level in order to put the signal writing transistor $TR_W$ in a turned-on state, the video signal $V_{Sig}$ appearing on the data line $DTL_n$ is written into the first node $ND_1$ by way of the signal writing transistor $TR_W$. As a result, the electric potential appearing on the second node $ND_2$ rises to a level obtained by subtracting the threshold voltage $V_{th}$ of the device driving transistor $TR_D$ from the video signal $V_{Sig}$.

That is to say, if the electric potential appearing on the second node $ND_2$ connected to the gate electrode of the device driving transistor $TR_D$ has been initialized at a level putting the device driving transistor $TR_D$ in a turned-on state at the beginning of the mth horizontal scan period by carrying out the second-node electric-potential initialization process during the (m−1)th horizontal scan period, the electric potential appearing on the second node $ND_2$ rises toward the video signal $V_{Sig}$ applied to the first node $ND_1$. As the difference in electric potential between the gate electrode and the specific one of the source and drain areas of the device driving transistor $TR_D$ attains the threshold voltage $V_{th}$ of the device driving transistor $TR_D$, however, the device driving transistor $TR_D$ is put in a turned-off state in which the electric potential appearing on the second node $ND_2$ is about equal to an electric-potential difference of $(V_{Sig}-V_{th})$.

Later on, a driving current flows from the first power-supply line $PS_1$ to the light emitting device ELP by way of the device driving transistor $TR_D$, driving the light emitting device ELP to emit light.

The transition to a state in which the driving current flows from the first power-supply line $PS_1$ to the light emitting device ELP by way of the device driving transistor $TR_D$, driving the light emitting device ELP to emit light is explained by referring to the diagrams of FIGS. 8A and 8D as follows. At the beginning of a (m+1)th horizontal scan period not shown explicitly in the diagram of FIG. 8A, the electric potential appearing on the scan line $SCL_m$ is changed from a low level to a high level. Afterwards, the electric potential appearing on the third/fourth-transistor control line $CL_m$ is changed conversely from a high level to a low level. It is to be noted that, at that time, the electric potential appearing on the scan line $SCL_{m-1}$ is sustained at a high level. As a result, during the (m+1)th horizontal scan period, each of the third transistor $TR_3$ and the fourth transistor $TR_4$ is put in a turned-on state whereas each of the signal writing transistor $TR_W$, the first transistor $TR_1$ and the second transistor $TR_2$ is conversely put in a turned-off state.

During the (m+1)th horizontal scan period, a driving voltage $V_{CC}$ appearing on the first power-supply line $PS_1$ is applied to the specific one of the source and drain areas of the device driving transistor $TR_D$ through the third transistor $TR_3$ which has been put in the turned-on state. The other one of the source and drain areas of the device driving transistor $TR_D$ is connected to the anode electrode of the light emitting device ELP by the fourth transistor $TR_4$ which has been put in the turned-on state.

Since the driving current flowing through the light emitting device ELP is a source-to-drain current $I_{ds}$ flowing from the source area of the device driving transistor $TR_D$ to the drain area of the same transistor, if the device driving transistor $TR_D$ is ideally operating in a saturated region, the driving current can be expressed by Eq. (A) given below. As shown in the circuit diagram of FIG. 8D, the source-to-drain current $I_{ds}$ is flowing to the light emitting device ELP, and the light emitting device ELP is emitting light at a luminance determined by the magnitude of the source-to-drain current $I_{ds}$.

$$I_{ds}=k\cdot\mu\cdot(V_{gs}-V_{th})^2 \quad \text{(A)}$$

In the above equation, reference notation μ denotes the effective mobility of the device driving transistor $TR_D$ whereas reference notation L denotes the length of the channel of the device driving transistor $TR_D$. Reference notation W denotes the width of the channel of the device driving transistor $TR_D$. Reference notation $V_{gs}$ denotes a voltage applied between the source area of the device driving transistor $TR_D$ and the gate electrode of the same transistor. Reference notation $C_{OX}$ denotes a quantity expressed by the following expression:

(Specific dielectric constant of the gate insulation layer of the device driving transistor $TR_D$)×(Vacuum dielectric constant)/(Thickness of the gate insulation layer of the device driving transistor $TR_D$)

Reference notation k denotes an expression as follows:

$$k=(1/2)\cdot(W/L)\cdot C_{OX}$$

The voltage $V_{gs}$ applied between the source area of the device driving transistor $TR_D$ and the gate electrode of the same transistor is expressed as follows:

$$V_{gs}\approx V_{CC}-(V_{Sig}-V_{th}) \quad \text{(B)}$$

By substituting the expression on the right-hand side of Eq. (B) into the expression on the right-hand side of Eq. (A) to serve as a replacement of the term $V_{gs}$ included in the expression on the right-hand side of Eq. (A), Eq. (C) can be derived from Eq. (A) as follows:

$$\begin{aligned} I_{ds} &= k\cdot\mu\cdot(V_{CC}-(V_{Sig}-V_{th})-V_{th})^2 \\ &= k\cdot\mu\cdot(V_{CC}-V_{Sig})^2 \end{aligned} \quad \text{(C)}$$

As is obvious from Eq. (C), the source-to-drain current $I_{ds}$ is not dependent on the threshold voltage $V_{th}$ of the device driving transistor $TR_D$. In other words, it is possible to generate the source-to-drain current $I_{ds}$ in accordance with the video signal $V_{Sig}$ as a current flowing to the light emitting device ELP with a magnitude not affected by the threshold voltage $V_{th}$ of the device driving transistor $TR_D$. In accordance with the driving method described above as a method for driving the light emitting device ELP, variations of the threshold voltage $V_{th}$ of the device driving transistor $TR_D$ from transistor to transistor by no means have an effect on the luminance of light emitted by the light emitting device ELP.

SUMMARY OF THE INVENTION

However, each of characteristics each exhibited by the device driving transistor $TR_D$ as a characteristic other than the threshold voltage $V_{th}$ of the device driving transistor $TR_D$ also has variations from transistor to transistor. In the case of a thin-film transistor created to serve as the device driving transistor $TR_D$ for example, the mobility μ of the device driving transistor $TR_D$ or another characteristic also has variations from transistor to transistor and the effects of the variations are difficult to eliminate. Unfortunately, the driving method described in the section with the title "BACKGROUND OF THE INVENTION" as a method for driving the light emitting device ELP is not capable of compensating the source-to-drain current $I_{ds}$ for variations of the mobility μ of the device driving transistor $TR_D$ or another characteristic. If the mobility μ of the device driving transistor $TR_D$ has variations from transistor to transistor for example, the magnitude of a source-to-drain current $I_{ds}$ flowing through a device driving transistor $TR_D$ having a large mobility μ is greater than the magnitude of a source-to-drain current $I_{ds}$ flowing through a device driving transistor $TR_D$ having a small mobility μ even if the same video signal $V_{Sig}$ is applied to both a light emitting unit employing the device driving transistor $TR_D$ having a large mobility μ and a light emitting unit employing the device driving transistor $TR_D$ having a small mobility μ. Thus, the light emitting device employed in the same light emitting unit as the device driving transistor $TR_D$ having a large mobility μ emits light with a high luminance in comparison with the light emitting device employed in the same light emitting unit as the device driving transistor $TR_D$ having a small mobility μ. As a result, the display apparatus loses image uniformity.

In order to solve the problem described above, inventors of the present invention have innovated a display apparatus capable of lowering the degree of image-uniformity deterioration caused by variations of the mobility μ of the device driving transistor and innovated a driving method for driving the display apparatus.

In order to solve the problems described above, there is provided a display apparatus according to an embodiment of the present invention or a display apparatus to which a driving method according to an embodiment of the present invention is applied. The display apparatus employs:

(1): N×M light emitting units laid out to form a two-dimensional matrix composed of N matrix columns oriented in a first direction and M matrix rows oriented in a second direction;

(2): M scan lines each stretched in the first direction; and (3): N data lines each stretched in the second direction.

Each of the light emitting units includes:

(4): a driving circuit, which has a signal writing transistor, a device driving transistor, a capacitor and a first switch circuit; and (5): a light emitting device configured to emit light at a luminance according to a driving current output by the device driving transistor to the light emitting device.

In each of the light emitting units, (A-1): a specific one of the source and drain areas of the signal writing transistor is connected to one of the data lines;

(A-2): the gate electrode of the signal writing transistor is connected to one of the scan lines;

(B-1): a specific one of the source and drain areas of the device driving transistor is connected to the other one of the source and drain areas of the signal writing transistor through a first node;

(C-1): a specific one of the terminals of the capacitor is connected to a power-supply line conveying a reference voltage determined in advance;

(C-2): the other one of the terminals of the capacitor is connected to the gate electrode of the device driving transistor through a second node;

(D-1): a specific one of the terminals of the first switch circuit is connected to the second node; and (D-2): the other one of the terminals of the first switch circuit is connected to the other one of the source and drain areas of the device driving transistor.

The driving method provided for the display apparatus according to the embodiment of the present invention to serve as a driving method for solving the problems described above has a second-node electric-potential correction process of changing an electric potential appearing on the second node by applying a voltage having a magnitude determined in advance to the first node for a time period determined in advance with the first switch circuit already put in a turned-on state in order to put the second node in a state of being electrically connected to the other one of the source and drain areas of the device driving transistor.

The display apparatus provided by the embodiment of the present invention to serve as a display apparatus for solving the problems described above is a display apparatus which changes an electric potential appearing on the second node by applying a voltage having a magnitude determined in advance to the first node for a time period determined in advance with the first switch circuit already put in a turned-on state in order to put the second node in a state of being electrically connected to the other one of the source and drain areas of the device driving transistor.

In accordance with the display apparatus provided by the embodiment of the present invention or the driving method for driving the display apparatus, an electric potential appearing on the second node is changed by applying a voltage having a magnitude determined in advance to the first node for a time period determined in advance with the first switch circuit already been put in a turned-on state in order to put the second node in a state of being electrically connected to the other one of the source and drain areas of the device driving transistor. The magnitude of the change of the electric potential appearing on the second node varies in accordance with a characteristic of the device driving transistor. To put it in detail, a voltage having a magnitude determined in advance is applied to the first node for a time period determined in advance in order to allow a source-to-drain current to flow through the device driving transistor. Thus, while the source-to-drain current is flowing through the device driving transistor, an electric potential appearing on the other one of the source and drain areas of the device driving transistor rises by an electric-potential change ΔV which is referred to as an electric-potential correction value. If the mobility μ of the device driving transistor is large, the source-to-drain current flowing through the device driving transistor is also large, resulting in a large electric-potential change ΔV or a large electric-potential correction value ΔV. If the mobility μ of the device driving transistor is small, on the other hand, the source-to-drain current flowing through the device driving transistor is also small, resulting in a small electric-potential change ΔV or a small electric-potential correction value ΔV. Since the second node is electrically connected to the other one of the source and drain areas of the device driving transistor by the first switch circuit which has already been put in a turned-on state, the electric potential appearing on the second node also rises by the electric-potential change ΔV or the electric-potential correction value ΔV. As described above, the magnitude of the raise of the electric potential appearing on the second node varies in accordance with a characteristic of the device driving transistor. Since the magnitude of the raise of the electric potential appearing on the second node determines the magnitude of the source-to-drain current flowing through the device driving transistor, the source-to-drain current is compensated for variations of the characteristic of the device driving transistor. It is to be noted that the period during which the voltage having a magnitude determined in advance is being applied to the first node is determined in advance as a design value at the stage of designing the display apparatus.

The driving method provided for the display apparatus according to the embodiment of the present invention to serve as a driving method for solving the problems described above has a signal writing process of changing an electric potential appearing on the second node toward an electric potential, which is obtained as a result of subtracting the threshold voltage of the device driving transistor from the voltage of a video signal appearing on one of the data lines, by applying the video signal to the first node by way of the signal writing transistor which is put in a turned-on state by a signal appearing on one of the scan lines when the first switch circuit is put in a turned-on state in order to put the second node in a state of being electrically connected to the other one of the source and drain areas of the device driving transistor. It is possible to provide a desirable configuration in which, after the signal writing process has been completed, the second-node electric-potential correction process described above is carried out. In this case, it is possible to provide a desirable configuration in which, prior to the signal writing process, a second-node electric-potential initialization process is carried out in order to set the electric potential appearing on the second node at a reference electric potential determined in advance.

The driving method provided for the display apparatus according to the embodiment of the present invention to serve as a driving method including the desirable configurations described above includes a light emission process of driving the light emitting device by allowing a driving current generated by the device driving transistor to flow to the light emitting device through application of a driving voltage determined in advance to the first node. It is possible to provide a desirable configuration in which the light emission process is carried out after completion of the second-node electric-potential correction process. In this case, it is possible to provide a desirable configuration in which the driving voltage is applied to the first node as the voltage having a magnitude determined in advance during the second-node electric-potential correction process.

The display apparatus according to the embodiment of the present invention and the display apparatus to which a driving method according to the embodiment of the present invention is applied are collectively referred to simply as a display apparatus provided by the embodiment of the present invention in some cases. It is possible to provide the display apparatus provided by the embodiment of the present invention with a configuration in which the driving circuit further employs:

(E): a second switch circuit connected between the second node and a power-supply line conveying the initialization voltage;

(F): a third switch circuit connected between the first node and a power-supply line conveying a driving voltage; and (G): a fourth switch circuit connected between the other one of the source and drain areas of the device driving transistor and the specific one of the electrodes of the light emitting device.

In addition, it is possible to provide the driving method for driving the display apparatus provided by the embodiment of the present invention with a configuration including the steps of:

(a): carrying out a second-node electric-potential initialization process of sustaining each of the first, third and fourth switch circuits in a turned-off state and applying a predetermined initialization voltage appearing on a power-supply line to the second node by way of the second switch circuit put in a turned-on state and, then, putting the second switch circuit in a turned-off state in order to set an electric potential appearing on the second node at a reference electric potential determined in advance;

(b): carrying out a signal writing process of sustaining each of the second, third and fourth switch circuits in a turned-off state and putting the first switch circuit in a turned-on state to put the second node in a state of being electrically connected to the other one of the source and drain areas of the device driving transistor so as to apply a video signal appearing on one of the data lines to the first node by way of the signal writing transistor put in a turned-on state by a signal appearing on one of the scan lines in order to change an electric potential appearing on the second node toward an electric potential obtained as a result of subtracting the threshold voltage of the device driving transistor from the video signal;

(c): applying a signal asserted on one of the scan lines to the gate electrode of the signal writing transistor later on in order to put the signal writing transistor in a turned-off state; and (d): carrying out a light emission process of putting the first switch circuit in a turned-off state, sustaining the second switch circuit in a turned-off state, applying the driving voltage determined in advance to the first node by way of the third switch circuit which has already been put in a turned-on state, putting the other one of the source and drain areas of the device driving transistor in a state of being electrically connected to the specific one of the electrodes of the light emitting device by way of the fourth transistor put in a turned-on state later on in order to allow a driving current to flow from the device driving transistor to the light emitting device.

In addition, it is possible to provide a configuration in which, between the steps (c) and (d), the second-node electric-potential correction process is carried out by applying the driving voltage as a voltage with a magnitude determined in advance for a period determined in advance to the first node with the first switch circuit sustained at a turned-on state and the third switch circuit put in a turned-on state.

In addition, it is possible to provide the display apparatus with a configuration in which the second switch circuit employed in the driving circuit of the light emitting unit provided for the mth matrix row associated with the scan line $SCL_m$ is controlled by a scan signal asserted on the scan line $SCL_{m_pre_P}$ provided for a matrix row preceding the mth matrix row by P matrix rows where: suffix or notation m denotes an integer having a value of 1, 2, . . . or M; and notation P is an integer determined in advance for the display apparatus as an integer satisfying relations of $1 \leqq P < M$. This configuration offers a merit that it is not necessary to provide a new control circuit for controlling the second switch circuit. If the length of a wire connecting the scan line $SCL_{m_re_P}$ to the second switch circuit is taken into consideration, it is desirable to provide a configuration in which the integer P is set at 1 (that is, P=1).

In the display apparatus provided by the embodiment of the present invention, it is possible to make use of a light emitting device emitting light at a luminance determined by the magnitude of a driving current flowing through the light emitting device to serve as the light emitting device employed in every light emitting unit included in the display apparatus. Typical examples of the light emitting device are an organic EL (Electro Luminescence) light emitting device, an inorganic EL light emitting device, an LED (light emitting diode) light emitting device and a semiconductor laser light emitting device. If construction of a color planar display apparatus is taken into consideration, it is desirable to make use of the organic EL light emitting device to serve as the light emitting device employed in every light emitting unit included in the display apparatus.

In the display apparatus provided by the embodiment of the present invention, a reference voltage determined in advance is supplied to a specific one of the terminals of the capacitor. Thus, an electric potential appearing on the specific one of the terminals of the capacitor is sustained at the reference voltage determined in advance during an operation carried out by the display apparatus. The magnitude of the reference voltage determined in advance is not prescribed in particular. For example, it is possible to provide a desirable configuration in which the specific one of the terminals of the capacitor is connected to a power line conveying a driving voltage to be applied to the specific one of the terminals of the capacitor as the reference voltage determined in advance. As an alternative, it is also possible to provide a desirable configuration in which the specific one of the terminals of the capacitor is connected to a power line conveying a predetermined initialization voltage to be applied to the specific one of the terminals of the capacitor as the reference voltage determined in advance. As another alternative, it is also possible to provide a desirable configuration in which the specific one of the terminals of the capacitor is connected to a power line conveying a predetermined voltage to be applied to the other one of the electrodes of the light emitting device and the predetermined voltage is applied to the specific one of the terminals of the capacitor as the reference voltage determined in advance.

In the display apparatus provided by the embodiment of the present invention as a display apparatus with the desirable configurations described above, a commonly known configuration and a commonly known structure can be used respectively as the configuration and structure of each of a variety of lines such as the scan lines, the data lines and the power-supply lines. In addition, a commonly known configuration and a commonly known structure can be used respectively as the configuration and structure of the light emitting device. To put it concretely, if an organic EL light emitting device is used to serve as the light emitting device employed in every light emitting unit, typically, the organic EL light emitting device can be configured to include components such as an anode electrode, a hole transport layer, a light emitting layer, an electron transport layer and a cathode electrode. On top of that, a commonly known configuration and a commonly known structure can be used respectively as the configuration and structure of each of a variety of circuits such as a scan circuit connected to the scan lines and a signal outputting circuit connected to the data lines.

The display apparatus provided by the embodiment of the present invention can have the configuration of the so-called monochrome display apparatus. As an alternative, the display apparatus provided by the embodiment of the present invention can have a configuration in which a pixel, which is the light emitting unit, includes a plurality of sub-pixels each serving as a light emitting device. For example, a pixel may include three sub-pixels, i. e., a red-light emitting sub-pixel, a green-light emitting sub-pixel and a blue-light emitting sub-pixel. In addition, each of the three sub-pixels having types different from each other can be a set including an additional sub-pixel of a type determined in advance or a plurality of additional sub-pixels having types different from each other. For example, the set includes an additional sub-pixel for emitting light having the white color for increasing the luminance. As another example, the set includes an additional sub-pixel for emitting light having a complementary color for enlarging a color reproduction range. As a further example, the set includes an additional sub-pixel for emitting light having the yellow color for enlarging a color reproduction range. As a still further example, the set includes an additional sub-pixel for emitting light having the yellow and cyan colors for enlarging a color reproduction range.

Each of the signal writing transistor and the device driving transistor can be configured by making use of a TFT (Thin Film Transistor) of a p-channel type. It is to be noted that the signal writing transistor can be configured by making use of a TFT of an n-channel type. Each of the first, second, third and fourth switch circuits can be configured by making use of a commonly known switching device such as a TFT. For example, each of the first, second, third and fourth switch circuits can be configured by making use of a TFT of the p-channel type or a TFT of the n-channel type.

The capacitor employed in the driving circuit can be typically configured to include a specific electrode, another electrode and a dielectric layer sandwiched by the electrodes. The dielectric layer is an insulation layer. Each of the transistors and the capacitor, which compose the driving circuit, is created within a certain plane. For example, each of the transistors and the capacitor is created on a support body. If the light emitting device is an organic EL light emitting device for example, the light emitting device is created above the transistors and the capacitor composing the device driving transistor through the insulation layer. The other one of the source and drain areas of the device driving transistor is connected to a specific one of the electrodes of the light emitting device by way of another transistor. In the typical configuration shown in the diagram of FIG. 1, the specific electrode of the light emitting device is the anode electrode whereas the other transistor is the fourth switching circuit. Please be advised that it is possible to provide a configuration in which each of the transistors is created on a semiconductor substrate or the like.

The technical phrase 'the specific one of the two source and drain areas of a transistor' may be used to imply the source or drain area connected to a power supply in some cases. The turned-on state of a transistor is a state in which a channel has been created between the source and drain areas of the transistor. There is not raised a question as to whether a current is flowing from the specific one of the source and drain areas of the transistor to the other one of the source and drain areas of the transistor or vice versa in the turning-on state of the transistor. On the other hand, the turned-off state of a transistor is a state in which no channel has been created between the source and drain areas of the transistor. A particular one of the source and drain areas of a transistor is connected to a particular one of the source and drain areas of another transistor by creating the particular source and drain areas of the two transistors as areas occupying the same region. In addition, it is possible to create a source or drain area of a transistor from not only a conductive material, but also a layer made of substances of different kinds. Typical examples of the conductive material are poly-silicon and amorphous silicon which include impurities. The substances for making the layer include a metal, an alloy, conductive particles, a laminated structure of a metal, an alloy and conductive particles as well as an organic material (or a conductive polymer). In every timing chart referred to in the following description, the length of a time period along the horizontal axis representing the lapse of time is no more than a model quantity and does not necessarily represent a magnitude relative to a reference on the horizontal axis.

In accordance with the display apparatus provided by the embodiment of the present invention and the driving method provided by the embodiment of the present invention to serve as a method for driving the display apparatus, an electric potential appearing on the second node is changed by applying a voltage having a magnitude determined in advance to the first node for a time period determined in advance with the first switch circuit already put in a turned-on state in order to put the second node in a state of being electrically connected to the other one of the source and drain areas of the device driving transistor. The magnitude of the change of the electric potential appearing on the second node varies in accordance with a characteristic of the device driving transistor. To put it in detail, a voltage having a magnitude determined in advance is applied to the first node for a time period determined in advance in order to allow a source-to-drain current to flow through the device driving transistor. Thus, while the source-to-drain current is flowing through the device driving transistor, an electric potential appearing on the other one of the source and drain areas of the device driving transistor rises by an electric-potential change $\Delta V$ which is referred to as an electric-potential correction value. If the mobility $\mu$ of the device driving transistor is large, the source-to-drain current flowing by way of the device driving transistor is also large, resulting in a large electric-potential change $\Delta V$ or a large electric-potential correction value $\Delta V$. If the mobility $\mu$ of the device driving transistor is small, on the other hand, the source-to-drain current flowing through the device driving transistor is also small, resulting in a small electric-potential change $\Delta V$ or a small electric-potential correction value $\Delta V$. Since the second node is electrically connected to the other one of the source and drain areas of the device driving transistor, the electric potential appearing on the second node also rises by the electric-potential change ΔV or the electric-potential correction value ΔV. As described above, the magnitude of the raise of the electric potential appearing on the second node varies in accordance with a characteristic of the device driving transistor. Since the magnitude of the raise of the electric potential appearing on the second node determines the magnitude of the source-to-drain current flowing through the device driving transistor, the source-to-drain current is compensated for variations of the characteristic of the device driving transistor. Thus, the display apparatus provided by the embodiment of the present invention and the driving method provided by the embodiment of the present invention to serve as a method for driving the display apparatus are capable of lowering the degree of image-uniformity deterioration caused by variations of the mobility μ of the device driving transistor

BRIEF DESCRIPTION OF THE DRAWINGS

The features of the present invention will become clear from the following description of the preferred embodiments given with reference to the accompanying diagrams, in which.

DETAILED DESCRIPTION OF THE PREFERRED EMBODIMENT

A preferred embodiment of the invention is explained by referring to diagrams as follows.

Embodiment

An embodiment implements a display apparatus provided by the present invention and a driving method provided by the present invention to serve as a method for driving the display apparatus. The display apparatus provided by the embodiment is an organic EL (Electro Luminescence) display apparatus employing a plurality of light emitting units 10, which each have an organic EL light emitting device ELP and a driving circuit 11 for driving the organic EL light emitting device. In the following description, the light emitting unit is also referred to as a pixel circuit in some cases.

Figure 1:
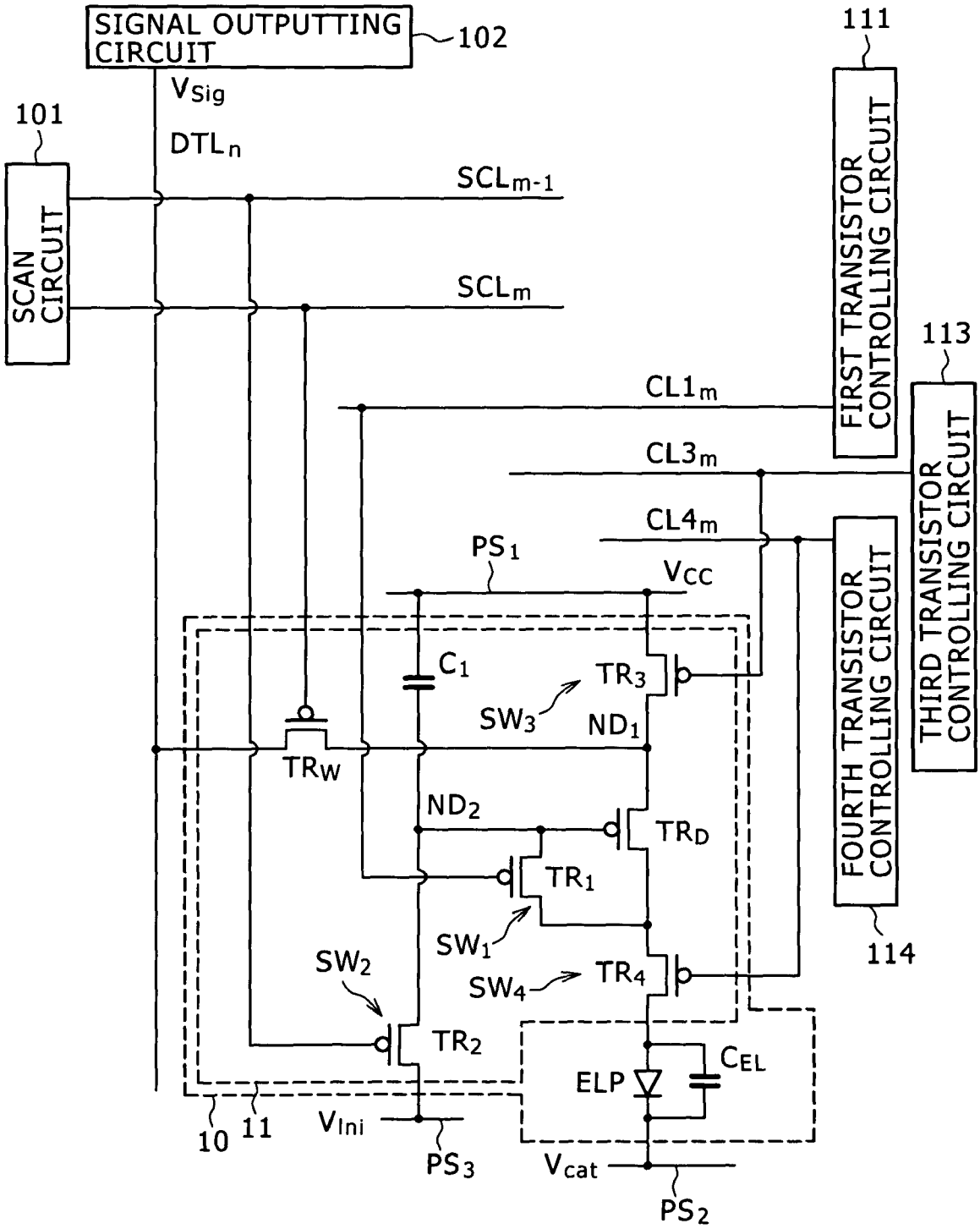
FIG. 1 is a diagram showing an equivalent circuit of a driving circuit employed in a light emitting unit located at the intersection of an mth matrix row and an nth matrix column in a two-dimensional matrix of N×M light emitting units employed in a display apparatus.
Figure 2:
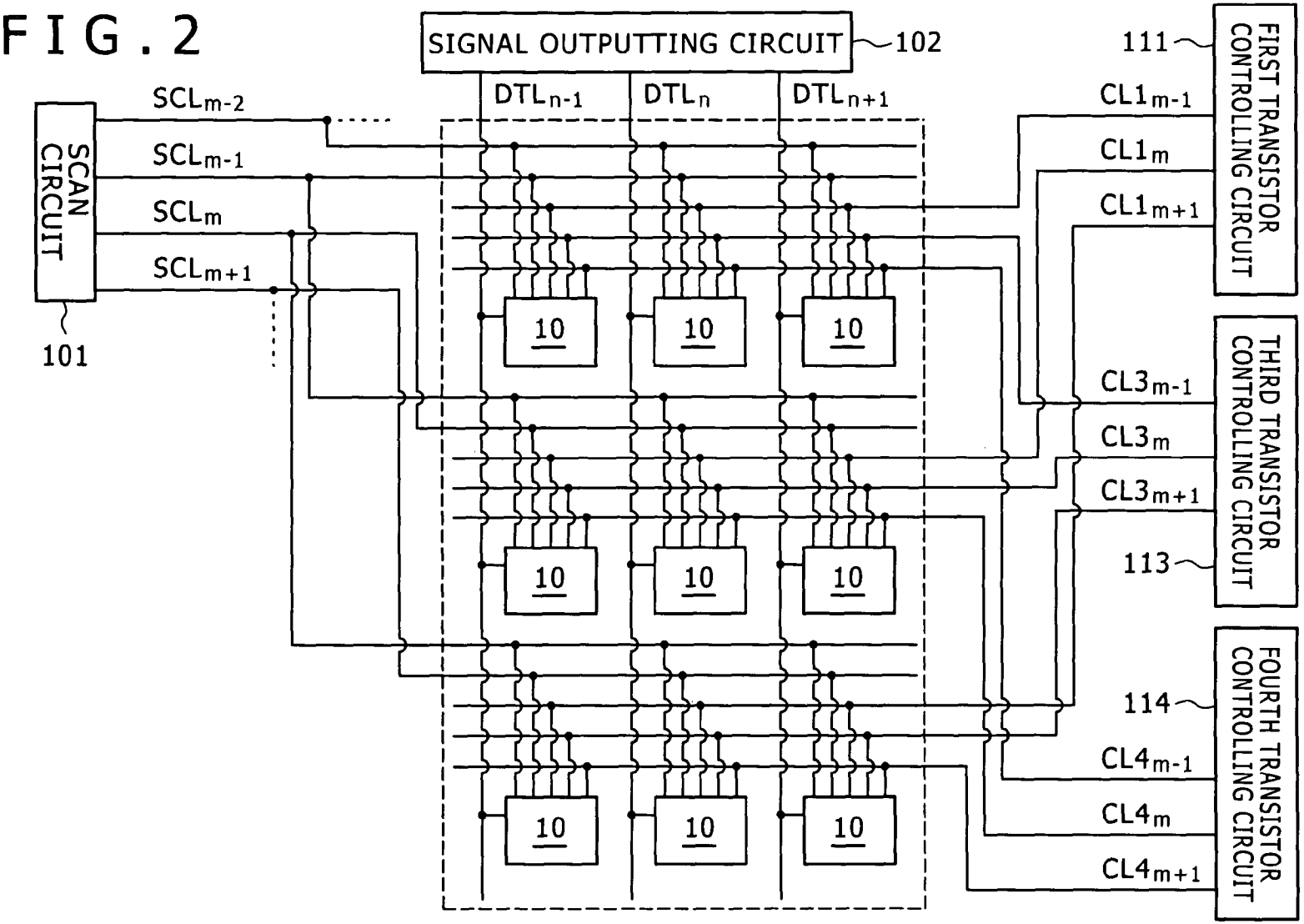
FIG. 2 is a conceptual diagram showing the display apparatus.

The display apparatus according to the embodiment is a display apparatus employing a plurality of pixel circuits. Every pixel circuit is configured to include a plurality of sub-pixel circuits. Every sub-pixel circuit is the light emitting unit 10 which has a laminated structure composed of the driving circuit 11 and the light emitting device ELP connected to the driving circuit 11. FIG. 1 is a diagram showing an equivalent circuit of the driving circuit 11 employed in the light emitting unit 10 located at the intersection of an mth matrix row and an nth matrix column in a two-dimensional matrix in which N×M light emitting units 10 employed in a display apparatus are laid out to form a two-dimensional matrix composed of N columns and M rows where suffix or notation m denotes an integer having a value of 1, 2, . . . or M and notation n denotes an integer having a value of 1, 2, . . . or N. FIG. 2 is a conceptual diagram showing the display apparatus.

As shown in the conceptual diagram of FIG. 2, the display apparatus employs:

(1): N×M light emitting units 10 laid out to form a two-dimensional matrix composed of N matrix columns oriented in a first direction and M matrix rows oriented in a second direction;

(2): M scan lines SCL each stretched in the first direction; and (3): N data lines DTL each stretched in the second direction.

Each of the M scan lines SCL is connected to a scan circuit 101 whereas each of the N data lines DTL is connected to a signal outputting circuit 102. The conceptual diagram of FIG. 2 shows 3×3 light emitting units 10 centered at a light emitting unit 10 located at the intersection of the mth matrix row and the nth matrix column. It is to be noted, however, that the configuration shown in the conceptual diagram of FIG. 2 is no more than a typical configuration. In addition, the conceptual diagram of FIG. 2 does not show power-supply lines $PS_1$, $PS_2$ and $PS_3$ for conveying voltages $V_{CC}$, $V_{Ini}$ and $V_{Cat}$ respectively as shown in the diagram of FIG. 1.

In the case of a color display apparatus, the two-dimensional matrix composed of N matrix columns and M matrix rows has (N/3)×M pixel circuits. However, every pixel circuit is configured to include three sub-pixels, i. e., a red-light emitting sub-pixel, a green-light emitting sub-pixel and a blue-light emitting sub-pixel. Thus, the two-dimensional matrix has N×M sub-pixel circuits which are each the light emitting unit 10 described above. The light emitting units 10 are sequentially scanned by the scan circuit 101 in row units on a row-after-row basis at a display frame rate of FR times per second. That is to say, (N/3) pixel circuits (or N sub-pixel circuits each functioning as the light emitting unit 10) arranged along the mth matrix row are driven at the same time. In other words, the light emission and no-light emission timings of the N light emitting devices 10 arranged along the mth matrix row are controlled in the same way.

The light emitting unit 10 employs a driving circuit 11 and a light emitting device ELP. The driving circuit 11 has a signal writing transistor $TR_W$, a device driving transistor $TR_D$, a capacitor $C_1$ and a first switch circuit $SW_1$ which is a first transistor $TR_1$ to be described later. A driving current generated by the device driving transistor $TR_D$ flows to the light emitting device ELP. In the light emitting unit 10 located at the intersection of mth matrix row and the nth matrix column, a specific one of the source and drain areas of the signal writing transistor $TR_W$ is connected to the data line $DTL_n$ whereas the gate electrode of the signal writing transistor $TR_W$ is connected to the scan line $SCL_m$. A specific one of the source and drain areas of the device driving transistor $TR_D$ is connected to the other one of the source and drain areas of the signal writing transistor $TR_W$ through a first node $ND_1$. A specific one of the terminals of the capacitor $C_1$ is connected to the first power-supply line $PS_1$ for conveying a reference voltage determined in advance. In the case of the embodiment shown in the diagram of FIG. 1, the reference voltage determined in advance is a reference voltage $V_{CC}$ to be described later. The other one of the terminals of the capacitor $C_1$ is connected to the gate electrode of the device driving transistor $TR_D$ through a second node $ND_2$.

Each of the device driving transistor $TR_D$ and the signal writing transistor $TR_W$ is a TFT of the p-channel type. The device driving transistor $TR_D$ is a depletion-type transistor. As will be described later, each of the first transistor $TR_1$, the second transistor $TR_2$, the third transistor $TR_3$ and the fourth transistor $TR_4$ is also a TFT of the p-channel type. It is to be noted that the signal writing transistor $TR_W$ can be implemented as a TFT of the n-channel type.

A commonly known configuration and a commonly known structure can be used respectively as the configuration and structure of each of the scan circuit 101, the signal outputting circuit 102, the scan line SCL and the data line DTL. By the same token, a commonly known configuration and a commonly known structure can be used respectively as the configuration and structure of each of a first-transistor control circuit 111, a third-transistor control circuit 113 and a fourth-transistor control circuit 114.

In the same way, a commonly known configuration and a commonly known structure can be used respectively as the configuration and structure of each of a first-transistor control line CL1, a third-transistor control line CL3 and a fourth-transistor control line CL4. Likewise, a commonly known configuration and a commonly known structure can be used respectively as the configuration and structure of each of a first power-supply line $PS_1$, a second power-supply line $PS_2$ and a third power-supply line $PS_3$ to be described later.

Figure 3:
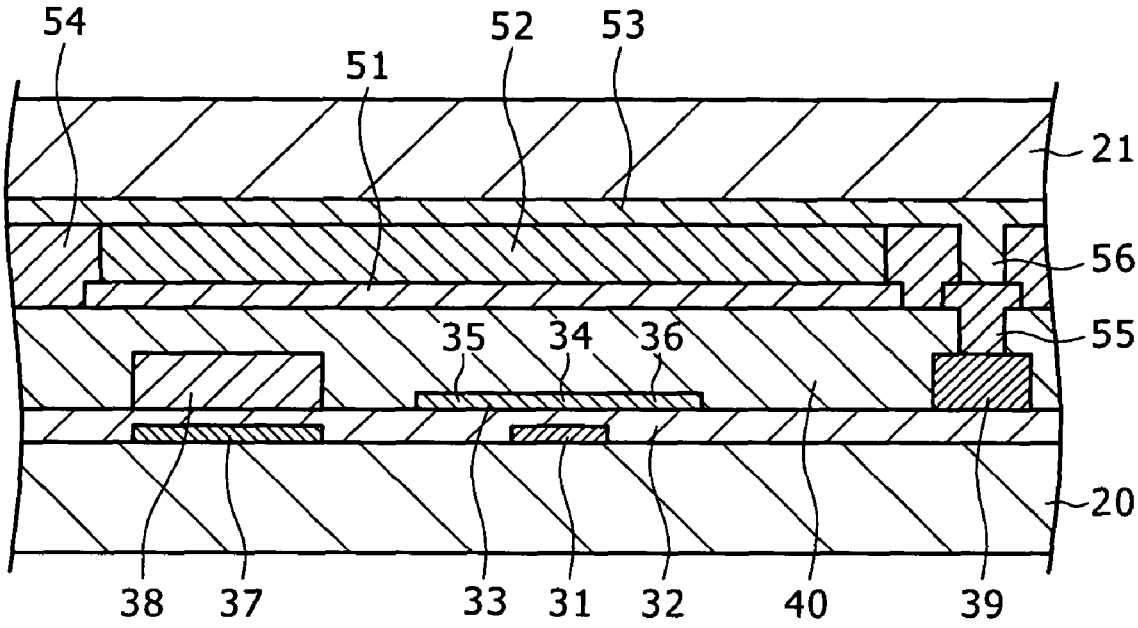
FIG. 3 is a model cross-sectional diagram showing the cross section of a portion of the light emitting unit employed in the display apparatus shown in the conceptual diagram of FIG. 2.

FIG. 3 is a model cross-sectional diagram showing the cross section of a portion of the light emitting unit 10 employed in the display apparatus shown in the conceptual diagram of FIG. 2. As will be described later in detail, every transistor and the capacitor $C_1$ which are employed in the driving circuit 11 of the light emitting unit 10 are created on a support body 20 whereas the light emitting device ELP is created over the transistors and the capacitor $C_1$. Typically, a first inter-layer insulation layer 40 is sandwiched between the light emitting device ELP and the driving circuit 11 which employs the transistors and the capacitor $C_1$. The organic EL light emitting device ELP has a commonly known configuration and a commonly known structure which include components such as an anode electrode, a hole transport layer, a light emitting layer, an electron transport layer and a cathode electrode. It is to be noted that the model cross-sectional diagram of FIG. 3 shows only the device driving transistor $TR_D$ while the other transistors are concealed and, thus, invisible. The other one of the source and drain areas of the device driving transistor $TR_D$ is connected to the anode electrode of the light emitting device ELP through the fourth transistor $TR_4$ not shown in the model cross-sectional diagram of FIG. 3. A portion connecting the fourth transistor $TR_4$ to the anode electrode of the light emitting device ELP is also concealed and, thus, invisible in the model cross-sectional diagram of FIG. 3.

The device driving transistor $TR_D$ is configured to include a gate electrode 31, a gate insulation layer 32 and a semiconductor layer 33. To put it more concretely, the device driving transistor $TR_D$ has a specific source or drain area 35 and the other source or drain area 36 which are provided on the semiconductor layer 33 as well as a channel creation area 34. Sandwiched by the specific source or drain area 35 and the other source or drain area 36, the channel creation area 34 is a portion pertaining to the semiconductor layer 33. Each of the other transistors not shown in the model cross-sectional diagram of FIG. 3 has the same configuration as the device driving transistor $TR_D$.

The capacitor $C_1$ has a capacitor electrode 37, a dielectric layer composed of an extension of the gate insulation layer 32 and another capacitor electrode 38. It is to be noted that a portion connecting the capacitor electrode 37 to the gate electrode 31 of the device driving transistor $TR_D$ and a portion connecting the capacitor electrode 38 to the first power-supply line $PS_1$ are concealed and, thus, invisible.

The gate electrode 31 of the device driving transistor $TR_D$, a portion of the gate insulation layer 32 of the device driving transistor $TR_D$ and capacitor electrode 37 of the capacitor $C_1$ are created on the support body 20. Components such as the device driving transistor $TR_D$ and the capacitor $C_1$ are covered by the first inter-layer insulation layer 40. On the first inter-layer insulation layer 40, the light emitting device ELP is provided. The light emitting device ELP has an anode electrode 51, a hole transport layer, a light emitting layer, an electron transport layer and a cathode electrode 53. It is to be noted that, in the model cross-sectional diagram of FIG. 3, the hole transport layer, the light emitting layer and the electron transport layer are shown as a single layer 52. On a portion pertaining to the first inter-layer insulation layer 40 as a portion on which the light emitting device ELP does not exist, a second inter-layer insulation layer 54 is provided. On the second inter-layer insulation layer 54 and the cathode electrode 53, a transparent substrate 21 is placed. Light emitted by the light emitting layer is radiated to the outside of the light emitting unit 10 by way of the transparent substrate 21. The cathode electrode 53 and the wire 39 serving as the second power-supply line $PS_2$ are connected to each other by contact holes 56 and 55 provided on the second inter-layer insulation layer 54 and the first inter-layer insulation layer 40.

A method for manufacturing the display apparatus shown in the conceptual diagram of FIG. 2 is explained as follows. First of all, components are created properly on the support body 20 by adoption of an already known method. The components include lines such as the scan lines, the electrodes of the capacitor $C_1$, the transistors each made of semiconductor layers, the inter-layer insulation layers and contact holes. Then, film-creation and patterning processes are carried out also by adoption of an already known method in order to form the light emitting devices ELP to form a two-dimensional matrix. Subsequently, the support body 20 completing the processes described above is positioned to face the transparent substrate 21. Finally the surroundings of the support body 20 and the transparent substrate 21 are sealed in order to finish the process of manufacturing the display apparatus. Later on, if necessary, wiring to external circuits is provided if necessary.

Next, by referring to the diagrams of FIGS. 1 and 2, the following description explains the driving circuit 11 employed in the light emitting unit 10 located at the intersection of the mth matrix row and the nth matrix column. As described before, the other one of the source and drain areas of the signal writing transistor $TR_W$ is connected to the specific one of the source and drain areas of the device driving transistor $TR_D$. On the other hand, the specific one of the source and drain areas of the signal writing transistor $TR_W$ is connected to the data line $DTL_n$. Operations to put the signal writing transistor $TR_W$ in a turned-on and turned-off states are controlled by a signal asserted on the scan line $SCL_m$ connected to the gate electrode of the signal writing transistor $TR_W$.

As will be described later in detail, the data line $DTL_n$ conveys a video signal $V_{Sig}$ which is also referred to as a driving signal or a luminance signal in order to control the luminance of light emitted by the light emitting device ELP from the signal outputting circuit 102. It is to be noted that a variety of signals and voltages other than the video signal $V_{Sig}$ may be supplied to the signal writing transistor $TR_W$ by way of the data line DTL. Typical examples of the signals and voltages other than the video signal $V_{Sig}$ are a signal used for carrying out a pre-charge driving operation and a variety of reference voltages.

In a light emission state of the light emitting unit 10, the device driving transistor $TR_D$ is driven to generate a source-to-drain current $I_{ds}$, the magnitude of which is expressed by Eq. (1) given below. In the light emission state of the light emitting unit 10, the specific one of the source and drain areas of the device driving transistor $TR_D$ is functioning as the source area whereas the other one of the source and drain areas of the device driving transistor $TR_D$ is functioning as the drain area. In order to make the following description easy to write just for the sake of convenience, in the following description, the specific one of the source and drain areas of the device driving transistor $TR_D$ is referred to as the source area whereas the other one of the source and drain areas of the device driving transistor $TR_D$ is referred to as the drain area in some cases. In Eq. (1) given below, reference notation μ denotes the effective mobility of the device driving transistor $TR_D$ whereas reference notation L denotes the length of the channel of the device driving transistor $TR_D$. Reference notation W denotes the width of the channel of the device driving transistor $TR_D$. Reference notation $V_{gs}$ denotes a voltage applied between the source area of the device driving transistor $TR_D$ and the gate electrode of the same transistor. Reference notation $V_{th}$ denotes the threshold voltage of the device driving transistor $TR_D$. Reference notation $C_{OX}$ denotes a quantity expressed by the following expression:

(Specific dielectric constant of the gate insulation layer of the device driving transistor $TR_D$)×(Vacuum dielectric constant)/(Thickness of the gate insulation layer of the device driving transistor $TR_D$)

Reference notation k denotes an expression as follows:

$$k \equiv (1/2)\cdot(W/L)\cdot C_{OX}$$

$$I_{ds} = k\cdot p\cdot(V_{gs} - V_{th})^2 \quad (1)$$

The driving circuit 11 is provided with a first switch circuit $SW_1$ connected between the second node $ND_2$ and the other one of the source and drain areas of the device driving transistor $TR_D$. The first switch circuit $SW_1$ is implemented as the first transistor $TR_1$. The specific one of the source and drain areas of the first transistor $TR_1$ is connected to the second node $ND_2$ whereas the other one of the source and drain areas of the first transistor $TR_1$ is connected to the other one of the source and drain areas of the device driving transistor $TR_D$.

Figure 7:
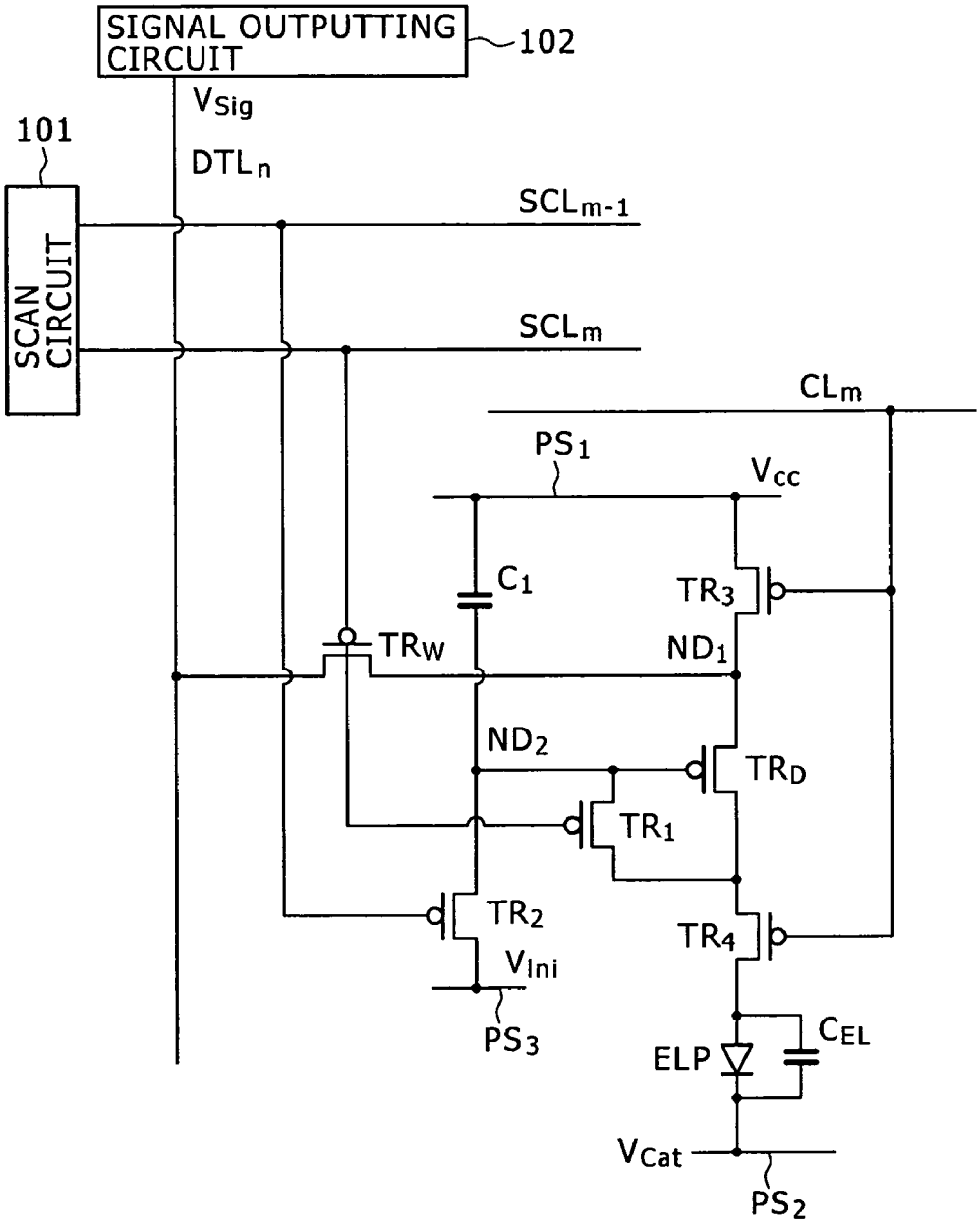
FIG. 7 RELATED ART
FIG. 7 is a diagram showing the equivalent circuit of a driving circuit included in a light emitting unit located at the intersection of an mth matrix row and an nth matrix column in a two-dimensional matrix of N×M light emitting units employed in a display apparatus.
Figure 8A:
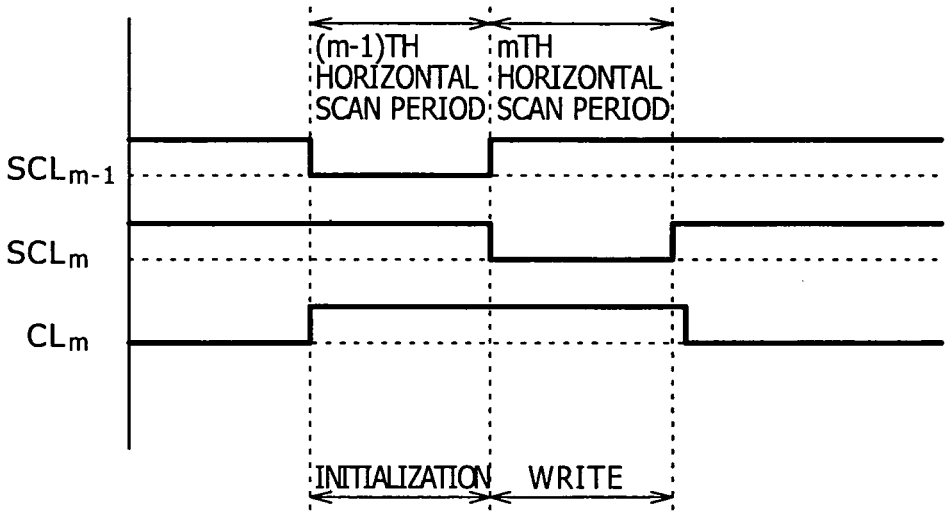
FIG. 8A RELATED ART
FIG. 8A is a model timing diagram showing timing charts of signals appearing on a scan line $SCL_{m-1}$, a scan line $SCL_m$ and a third/fourth-transistor control line $CL_m$.
Figure 8B:
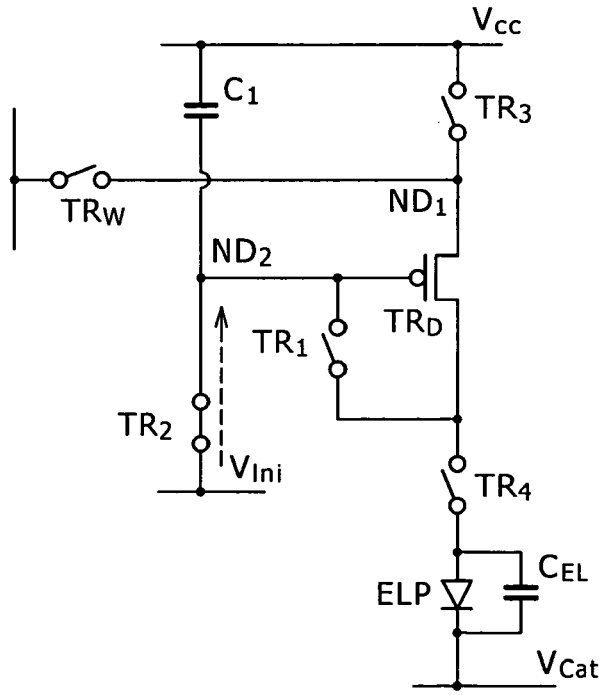
FIG. 8B RELATED ART
FIGS. 8B to 8D are model circuit diagrams showing the turned-on and turned-off states of transistors employed in the driving circuit.
Figure 8C:
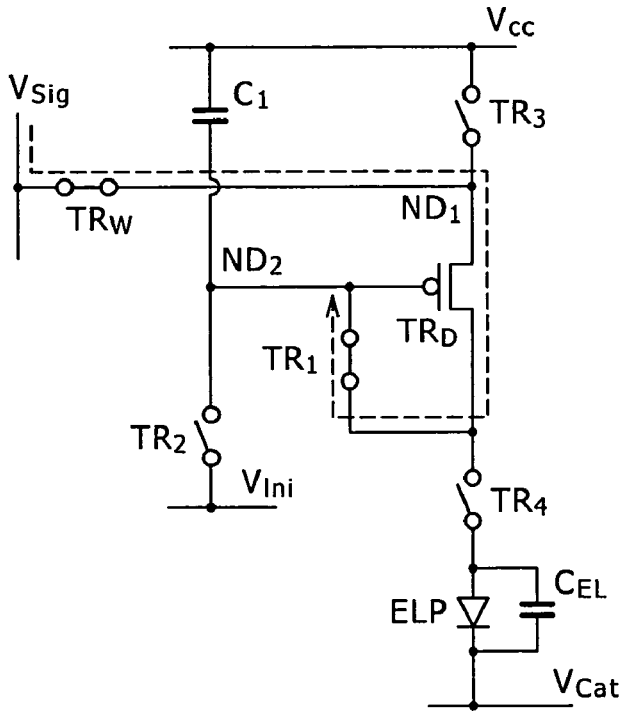
FIG. 8C RELATED ART
Figure 8D:
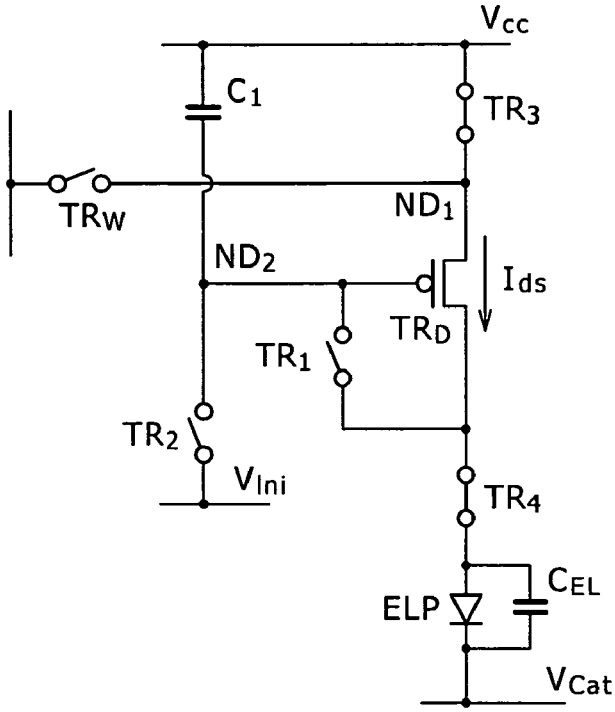
FIG. 8D RELATED ART

In the case of the driving circuit described earlier in the section with a title of "BACKGROUND OF THE INVENTION" by referring to the diagram shown in FIG. 7, the first transistor $TR_1$ functioning as the first switch circuit $SW_1$ is controlled by a signal asserted on the scan line $SCL_m$. In the case of this embodiment, on the other hand, the gate electrode of the first transistor $TR_1$ functioning as the first switch circuit $SW_1$ is connected to a first-transistor control line $CL\mathbf{1}_m$. The first-transistor control circuit 111 supplies a signal to the gate electrode of the first transistor $TR_1$ by way of the first-transistor control line $CL\mathbf{1}_m$ in order to put the first transistor $TR_1$ in a turned-on or turned-off state.

In addition, the driving circuit 11 is provided with a second switch circuit $SW_2$ connected between the second node $ND_2$ and the third power-supply line $PS_3$ for conveying a predetermined initialization voltage $V_{Ini}$ to be described later. The second switch circuit $SW_2$ is implemented as the second transistor $TR_2$. A specific one of the source and drain areas of the second transistor $TR_2$ is connected to the third power-supply line $PS_3$ whereas the other one of the source and drain areas of the second transistor $TR_2$ is connected to the second node $ND_2$.

The wiring connections of the second transistor $TR_2$ are described as follows. The gate electrode of the second transistor $TR_2$ serving as the second switch circuit $SW_2$ employed in the driving circuit 11 of the light emitting unit 10 provided for the mth matrix row associated with the scan line $SCL_m$ is connected to the scan line $SCL_{m_pre_P}$ provided for a matrix row preceding the mth matrix row by P matrix rows where: suffix or notation m denotes an integer having a value of 1, 2, . . . or M; and notation P is an integer determined in advance for the display apparatus as an integer satisfying relations of $1 \leqq P < M$. That is to say, the second switch circuit $SW_2$ is controlled by a scan signal asserted on the scan line $SCL_{m_pre_P}$. It is to be noted that, in the case of this embodiment, the integer P is set at 1 (that is, P=1). That is to say, a scan signal asserted on the scan line $SCL_{m-1}$ provided for a matrix row immediately preceding the mth matrix row is supplied to the gate electrode of the second transistor $TR_2$.

In addition, the driving circuit 11 is also provided with a third switch circuit $SW_3$ connected between the first node $ND_1$ and the first power-supply line $PS_1$ for conveying a driving voltage $V_{CC}$ to be described later. On top of that, the driving circuit 11 is further provided with a fourth switch circuit $SW_4$ connected between the other one of the source and drain areas of the device driving transistor $TR_D$ and a specific one of the electrodes of the light emitting device ELP. The third switch circuit $SW_3$ is implemented as the third transistor $TR_3$. A specific one of the source and drain areas of the third transistor $TR_3$ is connected to the first power-supply line $PS_1$ whereas the other one of the source and drain areas of the third transistor $TR_3$ is connected to the first node $ND_1$.

The fourth switch circuit $SW_4$ is implemented as the fourth transistor $TR_4$. A specific one of the source and drain areas of the fourth transistor $TR_4$ is connected to the other one of the source and drain areas of the device driving transistor $TR_D$ whereas the other one of the source and drain areas of the fourth transistor $TR_4$ is connected to the specific one of the electrodes of the light emitting device ELP. The other electrode of the light emitting device ELP is the cathode electrode of the light emitting device ELP. The cathode electrode of the light emitting device ELP is connected to the second power-supply line $PS_2$ for conveying a cathode voltage $V_{Cat}$ to be described later. Reference notation $C_{EL}$ denotes the parasitic capacitance of the light emitting device ELP.

In the case of the driving circuit described earlier in the section with a title of "BACKGROUND OF THE INVENTION" by referring to the diagram shown in FIG. 7, the gate electrodes of the third transistor $TR_3$ and the fourth transistor $TR_4$ are connected to the third/fourth-transistor control line $CL_m$. In the case of this embodiment, on the other hand, the gate electrode of the third transistor $TR_3$ is connected to a third-transistor control line $CL3_m$ whereas the gate electrode of the fourth transistor $TR_4$ is connected to a fourth-transistor control line $CL4_m$.

In this embodiment, the third-transistor control circuit 113 supplies a signal to the gate electrode of the third transistor $TR_3$ by way of the third-transistor control line $CL3_m$ in order to control transitions of the third transistor $TR_3$ from a turned-on state to a turned-off state and vice versa. By the same token, the fourth-transistor control circuit 114 supplies a signal to the gate electrode of the fourth transistor $TR_4$ by way of the fourth-transistor control line $CL4_m$ in order to control transitions of the fourth transistor $TR_4$ from a turned-on state to a turned-off state and vice versa.

A commonly known configuration and a commonly known structure can be used respectively as the configuration and structure of each of the first-transistor control circuit 111, the third-transistor control circuit 113 and the fourth-transistor control circuit 114.

In the explanation of the embodiment, a variety of voltages and electric potentials have the following typical values even though the values shall be regarded as values merely used in the explanation and are not to be interpreted as limitations imposed on the voltages and the electric potentials.

Reference notation $V_{Sig}$ denotes a video signal for controlling the luminance of light emitted by the light emitting device ELP. The video signal $V_{Sig}$ has a typical value in the range 0 volt representing the maximum luminance to 8 volts representing the minimum luminance.

Reference notation $V_{CC}$ denotes a driving voltage applied to the first power-supply line $PS_1$. The reference voltage $V_{CC}$ has a typical value of 10 volts.

Reference notation $V_{Ini}$ denotes an initialization voltage applied to the third power-supply line $PS_3$ to serve as a voltage for initializing an electric potential appearing on the second node $ND_2$. The initialization voltage $V_{Ini}$ has a typical value of −4 volts.

Reference notation $V_{th}$ denotes the threshold voltage of the device driving transistor $TR_D$. The threshold voltage $V_{th}$ has a typical value of 2 volts.

Reference notation $V_{Cat}$ denotes a voltage applied to the second power-supply line $PS_2$. The cathode voltage $V_{Cat}$ has a typical value of −10 volts.

The following description explains driving operations carried out by the display apparatus on the light emitting unit 10 located at the intersection of the mth matrix row and the nth matrix column. In the following description, the light emitting unit 10 located at the intersection of the mth matrix row and the nth matrix column is also referred to simply as the (n, m)th light emitting unit 10 or the (n, m)th sub-pixel circuit. The horizontal scan period of the light emitting units 10 arranged along the mth matrix row is referred to hereafter simply as the mth horizontal scan period. To put it concretely, the horizontal scan period of the light emitting units 10 arranged along the mth matrix row is the mth horizontal scan period of a currently displayed frame.

Figure 4:
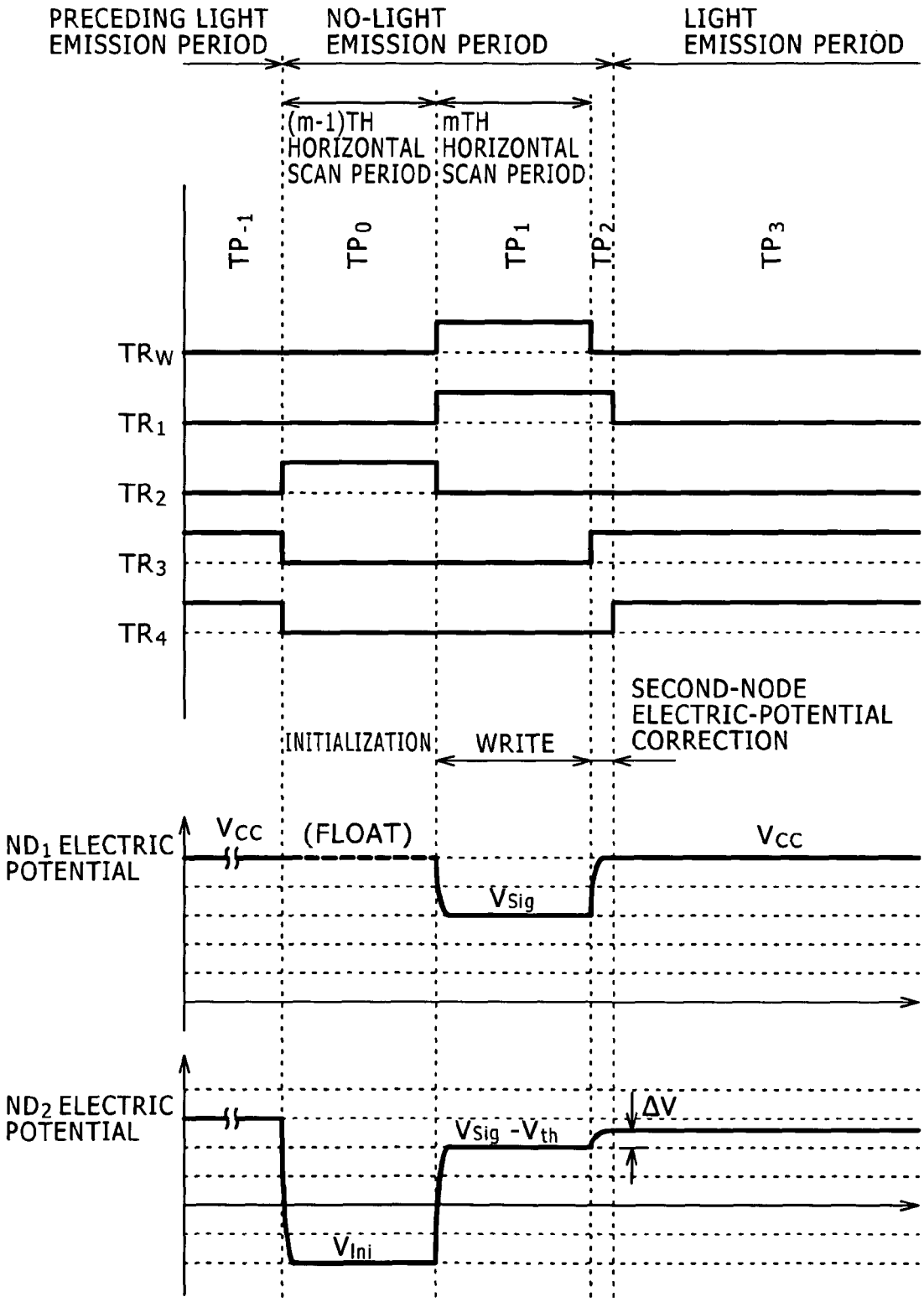
FIG. 4 is a timing diagram showing a model of timing charts of signals involved in driving operations carried out by the display apparatus.

A model of timing charts of signals involved in the driving operations carried out by the display apparatus is shown in the timing diagram of FIG. 4. FIGS. 5A to 5E are model circuit diagrams showing turned-on and turned-off states of transistors in the driving circuit 11.

The driving method provided for the display apparatus according to the embodiment has a second-node electric-potential correction process of changing an electric potential appearing on the second node $ND_2$ by applying a voltage having a magnitude determined in advance to the first node $ND_1$ for a time period determined in advance with the first switch circuit $SW_1$ already put in a turned-on state in order to put the second node $ND_2$ in a state of being electrically connected to the other one of the source and drain areas of the device driving transistor $TR_D$. To put it concretely, the second-node electric-potential correction process is carried out during a period $TP_2$ shown in the timing diagram of FIG. 4.

The driving method according to the embodiment has a signal writing process of changing an electric potential appearing on the second node $ND_2$ toward an electric potential, which is obtained as a result of subtracting the threshold voltage $V_{th}$ of the device driving transistor $TR_D$ from the voltage of a video signal $V_{Sig}$ appearing the data line $DTL_n$, by applying the video signal $V_{Sig}$ to the first node $ND_1$ by way of the signal writing transistor $TR_W$ which is put in a turned-on state by a signal appearing the scan line $SCL_m$ when the first switch circuit $SW_1$ is put in a turned-on state in order to put the second node $ND_2$ in a state of being electrically connected to the other one of the source and drain areas of the device driving transistor $TR_D$. It is to be noted that, after a second-node electrical-potential initialization process to initialize an electric potential appearing on the second node $ND_2$ has been completed, the signal writing process is carried out prior to execution of the second-node electric-potential correction process described above. To put it concretely, the second-node electrical-potential initialization process is carried out during a period $TP_0$ shown in the timing diagram of FIG. 4 whereas the signal writing process is carried out during a period $TP_1$ shown in the timing diagram of FIG. 4.

The driving method according to the embodiment includes a light emission process of driving the light emitting device ELP by allowing a driving current generated by the device driving transistor $TR_D$ to flow to the light emitting device ELP through application of a driving voltage $V_{CC}$ determined in advance to the first node $ND_1$. The driving voltage $V_{CC}$ is applied to the first node $ND_1$ as the voltage having a magnitude determined in advance during the second-node electric-potential correction process. To put it concretely, the light emission process is carried out in a period $TP_3$ shown in the timing diagram of FIG. 4. The following description explains details of the processes carried out in the periods shown in FIG. 4 respectively. Period $TP_{-1}$ (With reference to FIGS. 4 and 5A)

The period $TP_{-1}$ serving as the period of a light emission process is the period in which the light emitting unit 10 serving as the (n, m)th sub-pixel circuit is in an immediately preceding light emission state of emitting light at a luminance according to a video signal $V'_{Sig}$ written right before. Each of the third transistor $TR_3$ and the fourth transistor $TR_4$ is put in a turned-on state whereas each of the signal writing transistor $TR_W$, the first transistor $TR_1$ and the second transistor $TR_2$ is conversely put in a turned-off state. Through the light emitting device ELP employed in the light emitting unit 10 serving as the (n, m)th sub-pixel circuit, the source-to-drain current $I'_{ds}$ expressed by Eq. (5) to be described later is flowing. Thus, the light emitting device ELP employed in the light emitting unit 10 serving as the (n, m)th sub-pixel circuit is emitting light with a luminance determined by the source-to-drain current $I'_{ds}$.

Figure 5A:
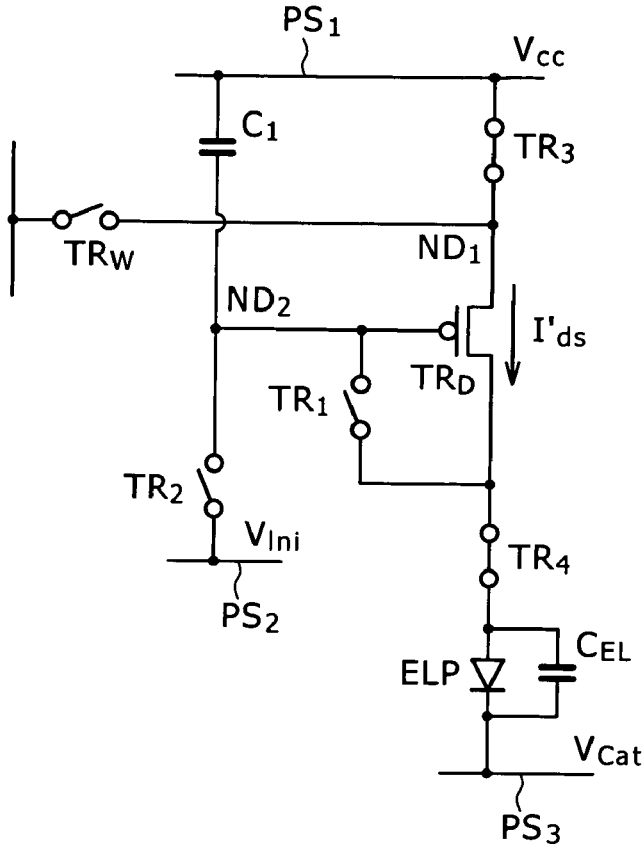
FIGS. 5A to 5E are model circuit diagrams showing turned-on and turned-off states of transistors in the driving circuit.
Figure 5B:
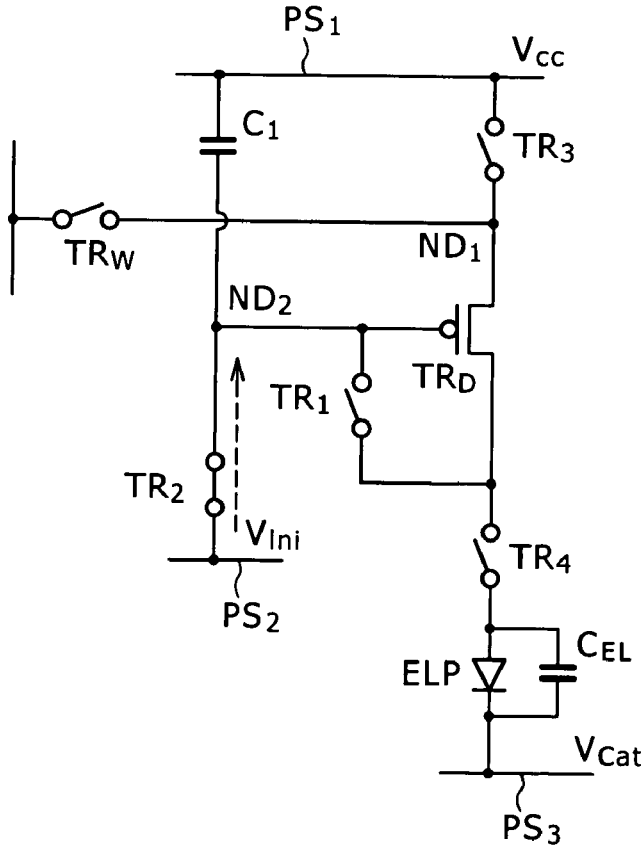

Period $TP_0$ (With Reference to FIGS. 4 and 5B)

The period $TP_0$ is the (m−1)th horizontal scan period of the currently displayed frame. During the period $TP_0$, each of the first switch circuit $SW_1$, the third switch circuit $SW_3$ and the fourth switch circuit $SW_4$ is sustained in a turned-off state. After the initialization voltage $V_{Ini}$ determined in advance is applied from the second power-supply line $PS_2$ conveying the initialization voltage $V_{Ini}$ to the second node $ND_2$ by way of the second switch circuit $SW_2$ which has already been put in a turned-on state, the second switch circuit $SW_2$ is put in a turned-off state in order to set an electric potential appearing on the second node $ND_2$ at a predetermined reference voltage which is the initialization voltage $V_{Ini}$ determined in advance. The process of setting the electric potential appearing on the second node $ND_2$ at the initialization voltage $V_{Ini}$ determined in advance is referred to as the second-node electric-potential initialization process.

To put it concretely, each of the signal writing transistor $TR_W$ and the first transistor $TR_1$ is sustained in a turned-off state whereas each of the third transistor $TR_3$ and the fourth transistor $TR_4$ is changed from a turned-on state to a turned-off state. Thus, the driving voltage $V_{CC}$ is not applied to the first node $ND_1$ and the light emitting device ELP is electrically disconnected from the device driving transistor $TR_D$. As a result, the source-to-drain current $I_{ds}$ does not flow to the light emitting device ELP, putting the light emitting device ELP in a no-light emission state. In addition, the second transistor $TR_2$ is changed from a turned-off state to a turned-on state so that the initialization voltage $V_{Ini}$ determined in advance is applied from the second power-supply line $PS_2$ conveying the initialization voltage $V_{Ini}$ to the second node $ND_2$ by way of the second transistor $TR_2$ put in a turned-on state. Then, the second transistor $TR_2$ is typically put in a turned-off state. In this state, a specific one of the terminals of the capacitor $C_1$ is connected to the first power-supply line $PS_1$ conveying the driving voltage $V_{CC}$ so that an electric potential appearing on the specific terminal of the capacitor $C_1$ is put in a state of being sustained at the $V_{CC}$. Thus, the electric potential appearing on the second node $ND_2$ is sustained at a predetermined level which is the level of the initialization voltage $V_{Ini}$ of −4 volts.

Figure 5C:
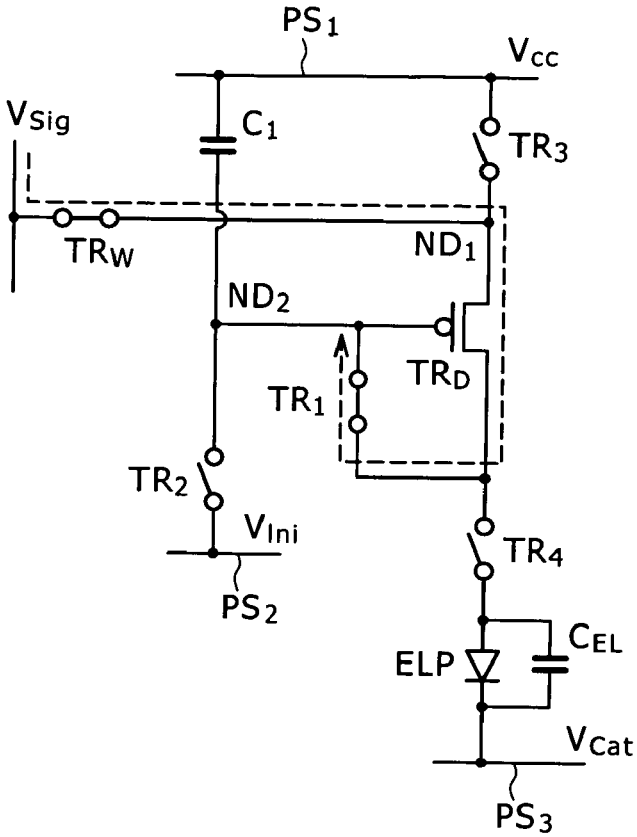

Period $TP_1$ (With Reference to FIGS. 4 and 5C)

The period $TP_1$ is the mth horizontal scan period of the currently displayed frame. In the period $TP_1$, each of the second switch circuit $SW_2$, the third switch circuit $SW_3$ and the fourth switch circuit $SW_4$ is put in a turned-off state whereas the first switch circuit $SW_1$ is conversely put in a turned-on state. With the first switch circuit $SW_1$ put in a turned-on state, the second node $ND_2$ is put in a state of being electrically connected to the other one of the source and drain areas of the device driving transistor $TR_D$ by way of the first switch circuit $SW_1$. In this state, the video signal $V_{Sig}$ asserted on the data line $DTL_n$ is supplied to the first node $ND_1$ by way of the signal writing transistor $TR_W$ which has already been put in a turned-on state by a signal asserted on the scan line $SCL_m$ so that the electric potential appearing on the second node $ND_2$ is raised toward a level obtained as a result of subtracting the threshold voltage $V_{th}$ of the device driving transistor $TR_D$ from the video signal $V_{Sig}$. The process of raising the electric potential appearing on the second node $ND_2$ toward such a level is referred to as the signal writing process.

To put it concretely, each of the second transistor $TR_2$, the third transistor $TR_3$ and the fourth transistor $TR_4$ is sustained in a turned-off state whereas the signal writing transistor $TR_W$ is put in a turned-on state by a signal asserted on the scan line $SCL_m$ and the first transistor $TR_1$ is put in a turned-on state by a signal asserted on the first-transistor control line $CL1_m$. With the first transistor $TR_1$ put in a turned-on state, the second node $ND_2$ is put in a state of being electrically connected to the other one of the source and drain areas of the device driving transistor $TR_D$ through the first transistor $TR_1$. In addition, the video signal $V_{Sig}$ asserted on the data line $DTL_n$ is supplied to the first node $ND_1$ by way of the signal writing transistor $TR_W$ which is put in a turned-on state by a signal asserted on the scan line $SCL_m$ so that the electric potential appearing on the second node $ND_2$ is changed to a level obtained as a result of subtracting the threshold voltage $V_{th}$ of the device driving transistor $TR_D$ from the video signal $V_{Sig}$.

That is to say, at the beginning of the period $TP_1$ of the signal writing process, the electric potential appearing on the second node $ND_2$ has been initialized at the initialization voltage $V_{Ini}$ for putting the device driving transistor $TR_D$ in a turned-on state by carrying out the second-node electric-potential initialization process during the period $TP_0$. In the period $TP_1$ of the signal writing process, however, the electric potential appearing on the second node $ND_2$ is raised toward the electric potential of the video signal $V_{Sig}$ applied to the first node $ND_1$. As the difference in electric potential between the gate electrode of the device driving transistor $TR_D$ and the specific one of the source and drain areas of the device driving transistor $TR_D$ attains the threshold voltage $V_{th}$ of the device driving transistor $TR_D$, however, the device driving transistor $TR_D$ is put in a turned-off state. In this state, the electric potential $V_{ND2}$ appearing on the second node $ND_2$ becomes equal to about $(V_{Sig}-V_{th})$. That is to say, the electric potential $V_{ND2}$ appearing on the second node $ND_2$ can be expressed by Eq. (2) given below. It is to be noted that, prior to the beginning of the (m+1)th horizontal scan period, a signal appearing on the scan line $SCL_m$ puts the signal writing transistor $TR_W$ in a turned-off state.

$$V_{ND2} \approx (V_{Sig}-V_{th}) \tag{2}$$

Figure 5D:
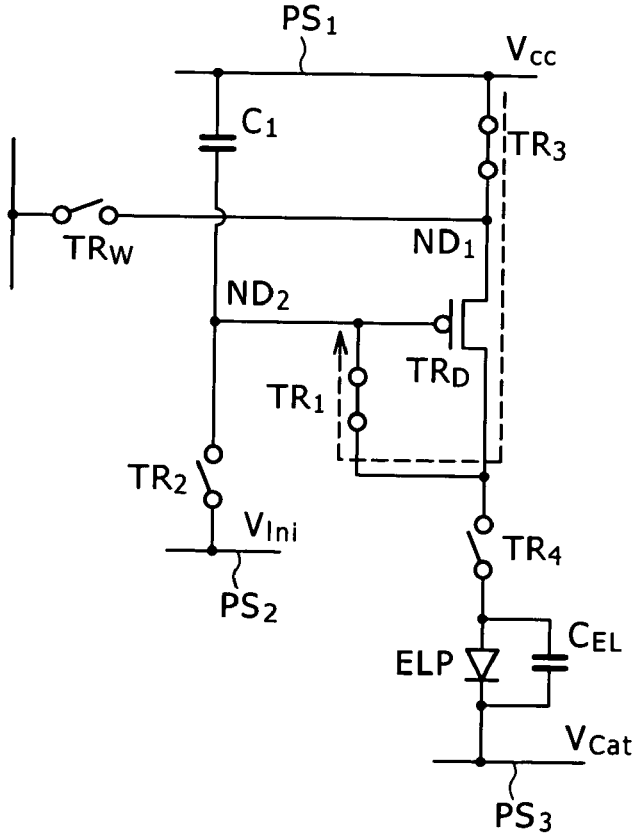

Period $TP_2$ (With reference to FIGS. 4 and 5D)

The period $TP_2$ is the period of the second-node electric-potential correction process of changing an electric potential appearing on the second node $ND_2$ by applying a voltage having a magnitude determined in advance to the first node $ND_1$ for a time period determined in advance with the first switch circuit $SW_1$ already put in a turned-on state in order to put the second node $ND_2$ in a state of being electrically connected to the other one of the source and drain areas of the device driving transistor $TR_D$. In the case of this embodiment, the second-node electric-potential correction process is carried out by applying the driving voltage $V_{CC}$ to the first node $ND_1$ as the voltage having a magnitude determined in advance for the time period determined in advance.

To put it concretely, the first transistor $TR_1$ is sustained in a turned-on state whereas the third transistor $TR_3$ is put in a turned-on state in order to apply the driving voltage $V_{CC}$ to the first node $ND_1$ as the voltage having a magnitude determined in advance for the period $TP_2$ also determined in advance. It is to be noted that each of the second transistor $TR_2$ and the fourth transistor $TR_4$ is sustained in a turned-off state. As a result, if the mobility μ of the device driving transistor $TR_D$ is large, the source-to-drain current flowing through the device driving transistor $TR_D$ is also large, resulting in a large electric-potential change ΔV or a large electric-potential correction value ΔV. If the mobility μ of the device driving transistor $TR_D$ is small, on the other hand, the source-to-drain current flowing through the device driving transistor $TR_D$ is also small, resulting in a small electric-potential change ΔV or a small electric-potential correction value ΔV. Since the second node $ND_2$ is electrically connected to the drain area of the device driving transistor $TR_D$ by the first switch circuit $SW_1$ which has already been put in a turned-on state, the electric potential $V_{ND2}$ appearing on the second node $ND_2$ also rises by the electric-potential change ΔV or the electric-potential correction value ΔV. The equation for expressing the electric potential $V_{ND2}$ appearing on the second node $ND_2$ is changed from Eq. (2) to Eq. (3) given as follows.

$$V_{ND2} \approx (V_{Sig} - V_{th}) + \Delta V \quad (3)$$

It is to be noted that the entire length $t_0$ of the period $TP_2$ during which the voltage having a magnitude determined in advance is being applied to the first node in the second-node electric-potential correction process is determined in advance as a design value at the stage of designing the display apparatus. In addition, by carrying out the second-node electric-potential correction process, the source-to-drain current $I_{ds}$ is also compensated at the same time for variations in coefficient k which is expressed as follows: $k \equiv (1/2) \cdot (W/L) \cdot C_{OX}$.

Figure 5E:
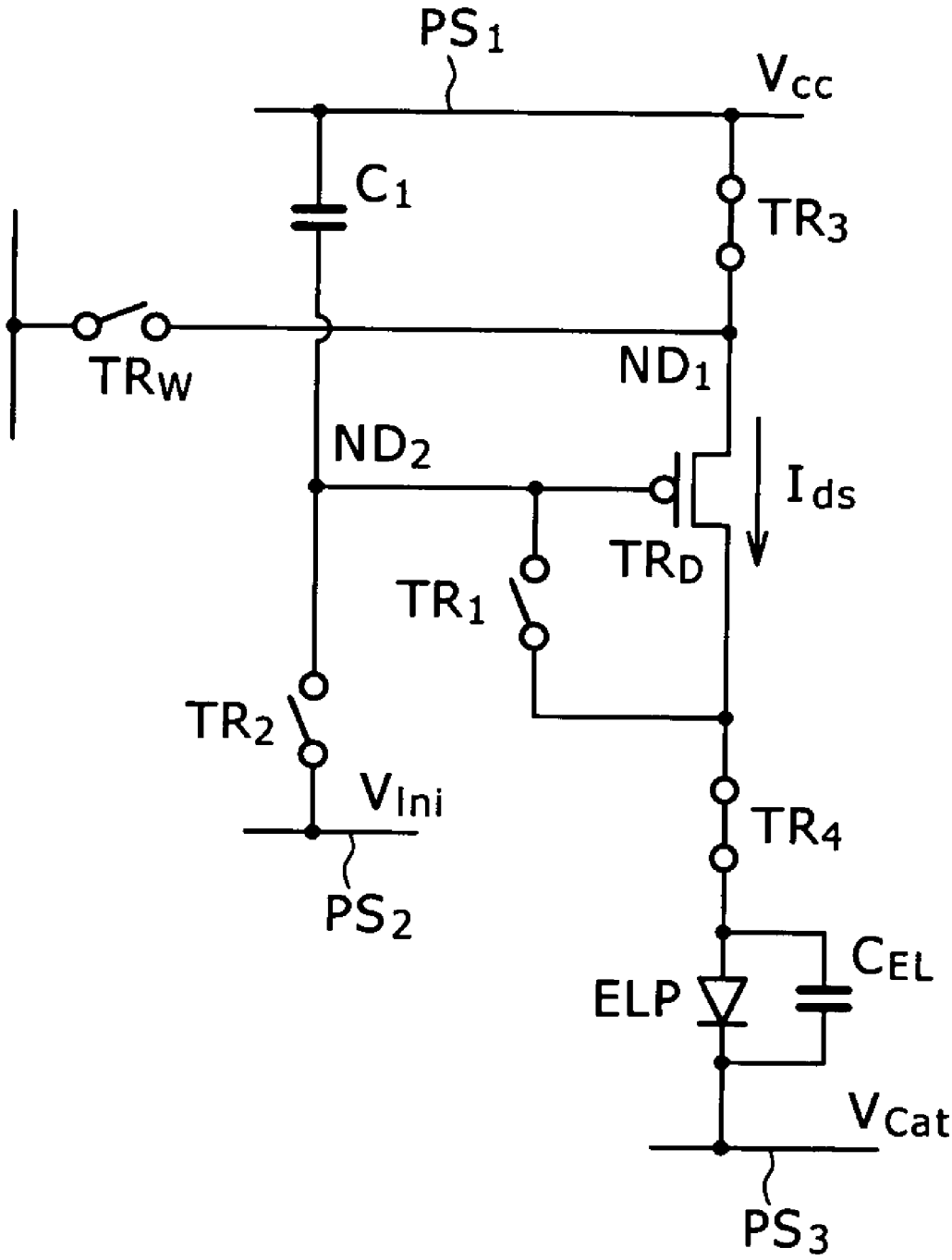

Period $TP_3$ (With Reference to FIGS. 4 and 5E)

The period $TP_3$ is the period of another light emission process. During the period $TP_3$, the first switch circuit $SW_1$ is put in a turned-off state whereas the second switch circuit $SW_2$ is sustained in a turned-off state. The predetermined driving voltage $V_{CC}$ is applied to the first node $ND_1$ by way of the third switch circuit $SW_3$ which has already been put in a turned-on state. The fourth switch circuit $SW_4$ put in a turned-on state puts the other one of the source and drain areas of the device driving transistor $TR_D$ in a state of being electrically connected the to a specific one of the electrodes of the light emitting device ELP, allowing a source-to-drain current $I_{ds}$ to flow to the light emitting device ELP. The process of allowing the source-to-drain current $I_{ds}$ to flow to the light emitting device ELP is referred to as the light emission process.

To put it concretely, at the beginning of the period $TP_3$, the first transistor $TR_1$ is put in a turned-off state whereas the second transistor $TR_2$ is sustained in a turned-off state but the third transistor $TR_3$ is sustained in a turned-on state. A signal asserted on the fourth-transistor control line $CL\mathbf{4}_m$ changes the state of the fourth transistor $TR_4$ from a turned-off state to a turned-on state. In these states, the predetermined driving voltage $V_{CC}$ is applied to the first node $ND_1$ by way of the third transistor $TR_3$ which has already been put in the turned-on state. In addition, by changing the state of the fourth transistor $TR_4$ from a turned-off state to a turned-on state, the other one of the source and drain areas of the device driving transistor $TR_D$ is put in a state of being electrically connected to a specific one of the electrodes of the light emitting device ELP, allowing a source-to-drain current $I_{ds}$ generated by the device driving transistor $TR_D$ to flow to the light emitting device ELP to serve as a driving current for driving the light emitting device ELP to emit light.

Following Eq. (4) is derived from Eq. (3).

$$V_{gs} \approx V_{CC} - ((V_{Sig} - V_{th}) + \Delta V) \quad (4)$$

Thus, Eq. (1) can be changed to following Eq. (5).

$$\begin{aligned} I_{ds} &= k \cdot \mu \cdot (V_{gs} - V_{th})^2 \\ &= k \cdot \mu \cdot ((V_{CC} - V_{Sig}) - \Delta V)^2 \end{aligned} \quad (5)$$

As is obvious from Eq. (5) given above, the source-to-drain current $I_{ds}$ flowing to the light emitting device ELP is proportional to the square of a difference between an electric-potential difference $(V_{CC} - V_{Sig})$ and the electric-potential correction value $\Delta V$ which is determined by the mobility $\mu$ of the device driving transistor $TR_D$. In other words, the source-to-drain current $I_{ds}$ flowing to the light emitting device ELP is not dependent on the threshold voltage $V_{th}$ of the device driving transistor $TR_D$. That is to say, the luminance (or the light quantity) of light emitted by the light emitting device ELP is not affected by the threshold voltage $V_{th}$ of the device driving transistor $TR_D$. The luminance of light emitted by the light emitting device ELP employed in the (n, m) light emitting unit 10 is a value determined by the source-to-drain current $I_{ds}$ flowing to the light emitting device ELP.

In addition, the larger the mobility $\mu$ of the device driving transistor $TR_D$, the larger the electric-potential correction value $\Delta V$. Thus, the larger the mobility $\mu$ of the device driving transistor $TR_D$, the smaller the value of the expression $((V_{CC} - V_{Sig}) - \Delta V)^2$ included in Eq. (5) or the smaller the magnitude of the source-to-drain current $I_{ds}$. As a result, the source-to-drain current $I_{ds}$ can be compensated for variations in mobility $\mu$ from transistor to transistor. That is to say, if a video signal $V_{Sig}$ having the same value is applied to different light emitting units 10 employing device driving transistors $TR_D$ having different values of the mobility $\mu$, the source-to-drain currents $I_{ds}$ generated by the device driving transistors $TR_D$ have magnitudes about equal to each other. As a result, the source-to-drain current $I_{ds}$ flowing to the light emitting device ELP as a driving current for controlling the luminance of light emitted by the light emitting device ELP can be made uniform for device driving transistors $TR_D$ provided that a video signal $V_{Sig}$ having the same value is applied to different light emitting units 10 employing the device driving transistors $TR_D$. Thus, it is possible to eliminate the effects of variations in mobility $\mu$ or the effects of variations in coefficient k, and it is therefore possible to eliminate the effects of variations of the luminance of light emitted by the light emitting device ELP.

The light emission state of the light emitting device ELP is sustained till the (m−2)th horizontal scan period of the immediately following frame. That is to say, the light emission state of the light emitting device ELP is sustained till the end of the period $TP_{-1}$ of the immediately following frame.

At the end of the light emission state of the light emitting device ELP, the series of processes of driving the light emitting unit 10 serving as the (n, m)th sub-pixel circuit as described above is completed.

The present invention has been exemplified above by taking a preferred embodiment as a typical example. However, implementations of the present invention are by no means limited to this preferred embodiment. That is to say, the configuration and structure of each component employed in the driving circuit 11 and the light emitting device ELP which are included in the light emitting unit 10 of the display apparatus according to the preferred embodiment as well as the processes of the method for driving the light emitting device ELP are typical examples and can thus be changed properly.

Figure 6:
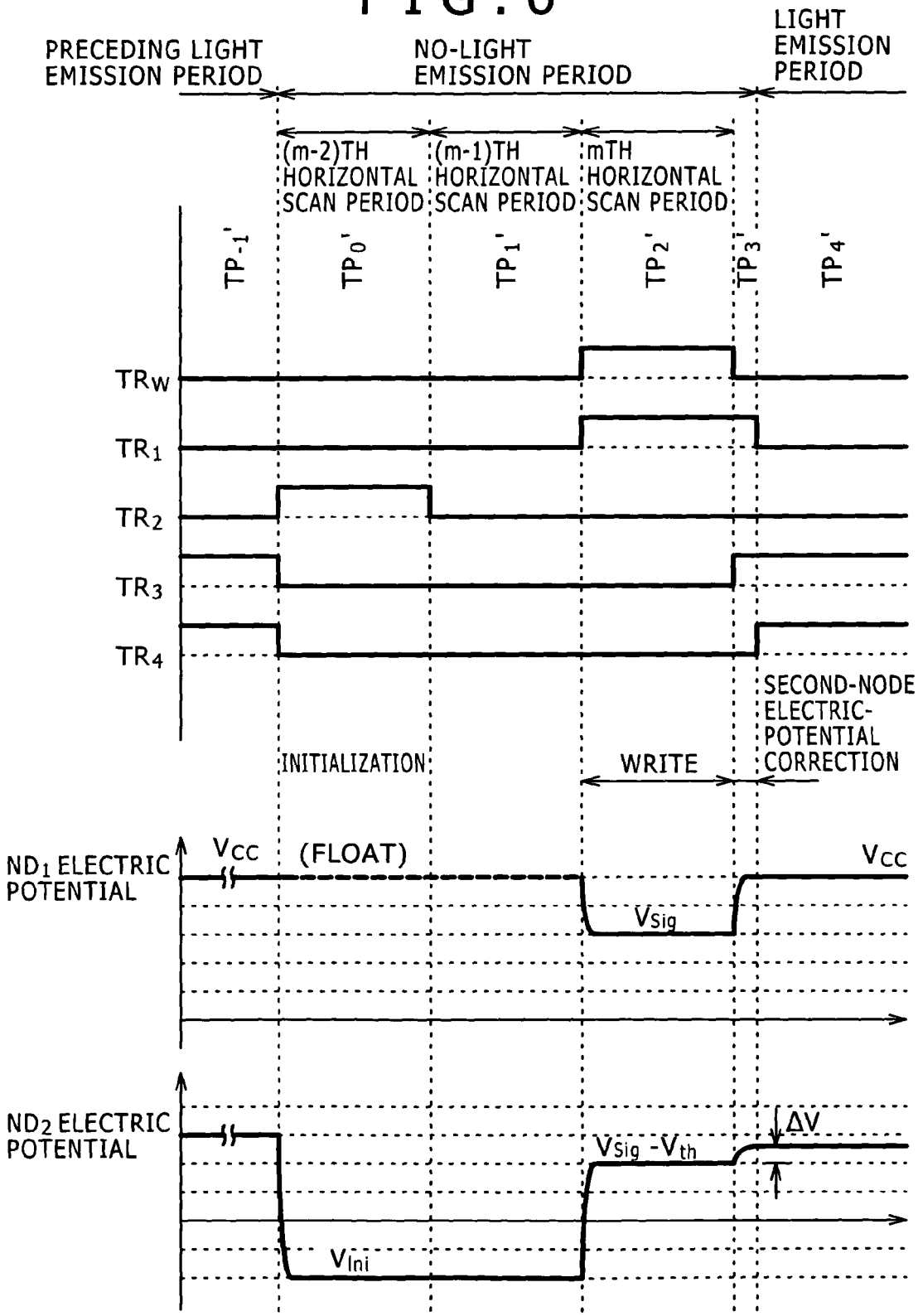
FIG. 6 is a timing diagram showing timing charts for a configuration in which a second switch circuit is driven by a scan signal provided for a matrix row preceding the matrix row associated with the light emitting unit employing the second switch circuit by two matrix rows.

For the purpose of explaining a typical modified version, FIG. 6 is given as a timing diagram showing timing charts for a configuration in which the second switch circuit $SW_2$ is driven by a scan signal asserted on a scan line $SCL_{m-2}$ provided for a matrix row preceding the matrix row associated with the light emitting unit 10 employing the second switch circuit $SW_2$ by two matrix rows. Operations carried out in periods $TP'_{-1}$ and $TP'_0$ shown in the timing diagram of FIG. 6 are identical with respectively the operations carried out in the periods $TP_{-1}$ and $TP_0$ shown in the timing diagram of FIG. 4. Unlike the period $TP_0$, which is the (m−1)th horizontal scan period for carrying out the second-node electric-potential initialization process, however, the period $TP'_0$ is the (m−2)th horizontal scan period in which the second-node electric-potential initialization process is also carried out.

In addition, in a period $TP'_1$ of the timing diagram of FIG. 6, all the signal writing transistor $TR_W$, the device driving transistor $TR_D$, the first transistor $TR_1$, the second transistor $TR_2$, the third transistor $TR_3$ and the fourth transistor $TR_4$ are sustained in a turned-off state in order to continue the state in which the electric potential appearing on the first $ND_1$ is initialized. Next operations carried out in periods $TP'_2$ to $TP'_4$ shown in the timing diagram of FIG. 6 are identical with respectively the operations carried out in the periods $TP_1$ to $TP_3$ shown in the timing diagram of FIG. 4. Thus, the light emitting device ELP can be driven in the same way as the embodiment described earlier.

The present application contains subject matter related to that disclosed in Japanese Priority Patent Application JP 2008-119838 filed in the Japan Patent Office on May 1, 2008, the entire content of which is hereby incorporated by reference.

It should be understood by those skilled in the art that various modifications, combinations, sub-combinations and alternations may occur depending on design requirements and other factors insofar as they are within the scope of the appended claims or the equivalent thereof.

What is claimed is:

1. A driving method for driving a display apparatus including N×M light emitting units laid out to form a two-dimensional matrix composed of N matrix columns oriented in a first direction and M matrix rows oriented in a second direction, M scan lines each stretched in said first direction, N data lines each stretched in said second direction, a driving circuit provided for each of said light emitting units to serve as a circuit having a signal writing transistor, a device driving transistor, a capacitor and a first switch circuit, and a light emitting device provided for each of said light emitting units to serve as a device to emit light at a luminance according to a driving current output by said device driving transistor to said light emitting device, wherein in each of said light emitting units a specific one of said source and drain areas of said signal writing transistor is connected to one of said data lines, the gate electrode of said signal writing transistor is connected to one of said scan lines, a specific one of said source and drain areas of said device driving transistor is connected to the other one of said source and drain areas of said signal writing transistor through a first node, a specific one of the terminals of said capacitor is connected to a power-supply line conveying a reference voltage determined in advance, the other one of said terminals of said capacitor is connected to the gate electrode of said device driving transistor through a second node, a specific one of said terminals of said first switch circuit is connected to said second node, and the other one of said terminals of said first switch circuit is connected to the other one of said source and drain areas of said device driving transistor, said driving method comprising:

a second-node electric-potential correction process carried out in order to change an electric potential appearing on said second node by applying a voltage having a magnitude determined in advance to said first node for a time period determined in advance with said first switch circuit already put in a turned-on state in order to put said second node in a state of being electrically connected to said other one of said source and drain areas of said device driving transistor.

2. The driving method in accordance with claim 1, further comprising:

a signal writing process of changing an electric potential appearing on said second node toward an electric potential, which is obtained as a result of subtracting the threshold voltage of said device driving transistor from the voltage of a video signal appearing on one of said data lines, by applying said video signal to said first node by way of said signal writing transistor which is put in a turned-on state by a signal appearing on one of said scan lines when said first switch circuit is put in a turned-on state in order to put said second node in a state of being electrically connected to said other one of said source and drain areas of said device driving transistor, wherein after said signal writing process has been completed, said second-node electric-potential correction process is carried out.

3. The driving method in accordance with claim 2 wherein, prior to said signal writing process, a second-node electric-potential initialization process is carried out in order to set said electric potential appearing on said second node at a reference electric potential determined in advance.

4. The driving method in accordance with claim 1, further comprising:

a light emission process of driving said light emitting device by allowing a driving current generated by said device driving transistor to flow to said light emitting device through application of a driving voltage determined in advance to said first node, wherein said light emission process is carried out after completion of said second-node electric-potential correction process.

5. The driving method in accordance with claim 4, wherein said driving voltage is applied to said first node as said voltage having a magnitude determined in advance during said second-node electric-potential correction process.

6. The driving method in accordance with claim 1, wherein said driving circuit provided for each of said light emitting units employed in said display apparatus further includes a second switch circuit connected between said second node and a power-supply line conveying an initialization voltage determined in advance, a third switch circuit connected between said first node and another power-supply line conveying a driving voltage, and a fourth switch circuit connected between said other one of said source and drain areas of said device driving transistor and a specific one of the electrodes of said light emitting unit, said driving method further comprising:

(a): carrying out a second-node electric-potential initialization process of sustaining each of said first, third and fourth switch circuits in a turned-off state and applying said predetermined initialization voltage appearing on said power-supply line to said second node by way of said second switch circuit put in a turned-on state and, then, putting said second switch circuit in a turned-off state in order to set an electric potential appearing on said second node at a reference electric potential determined in advance as said initialization voltage;

(b): carrying out a signal writing process of sustaining each of said second, third and fourth switch circuits in a turned-off state and putting said first switch circuit in a turned-on state to put said second node in a state of being electrically connected to said other one of said source and drain areas of said device driving transistor so as to apply a video signal appearing on one of said data lines to said first node by way of said signal writing transistor put in a turned-on state by a signal appearing on one of said scan lines in order to change an electric potential appearing on said second node toward an electric potential obtained as a result of subtracting said threshold voltage of said device driving transistor from said video signal;

(c): applying a signal asserted on one of said scan lines to said gate electrode of said signal writing transistor later on in order to put said signal writing transistor in a turned-off state; and (d): carrying out a light emission process of putting said first switch circuit in a turned-off state, sustaining said second switch circuit in a turned-off state, applying said driving voltage determined in advance to said first node by way of said third switch circuit which has already been put in a turned-on state, putting said other one of said source and drain areas of said device driving transistor in a state of being electrically connected to said specific one of said electrodes of said light emitting device by way of said fourth transistor put in a turned-on state later on in order to allow a driving current to flow from said device driving transistor to said light emitting device, whereby, between said steps (c) and (d), said second-node electric-potential correction process is carried out by applying said driving voltage as a voltage with a magnitude determined in advance for a period determined in advance to said first node with said first switch circuit sustained at a turned-on state and said third switch circuit put in a turned-on state.

7. The driving method in accordance with claim 6, wherein said second switch circuit employed in said driving circuit of said light emitting unit provided for the mth matrix row associated with said scan line $SCL_m$ is controlled by a scan signal asserted on a scan line $SCL_{m_pre_P}$ provided for a matrix row preceding said mth matrix row by P matrix rows where suffix or notation m denotes an integer having a value of 1, 2, . . . or M, and notation P is an integer determined in advance for said display apparatus as an integer satisfying relations of $1<P<M$.

8. The driving method in accordance with claim 7, wherein said integer P is set as 1.

9. The driving method in accordance with claim 1, wherein said light emitting device is an organic EL (Electro Luminescence) light emitting device.

10. A display apparatus comprising:

N×M light emitting units laid out to form a two-dimensional matrix composed of N matrix columns oriented in a first direction and M matrix rows oriented in a second direction;

M scan lines each stretched in said first direction;

N data lines each stretched in said second direction;

a driving circuit provided for each of said light emitting units to serve as a circuit having a signal writing transistor, a device driving transistor, a capacitor and a first switch circuit; and a light emitting device provided for each of said light emitting units to serve as a device to emit light at a luminance according to a driving current output by said device driving transistor to said light emitting device, wherein in each of said light emitting units, a specific one of said source and drain areas of said signal writing transistor is connected to one of said data lines, the gate electrode of said signal writing transistor is connected to one of said scan lines, a specific one of said source and drain areas of said device driving transistor is connected to the other one of said source and drain areas of said signal writing transistor through a first node, a specific one of the terminals of said capacitor is connected to a power-supply line conveying a reference voltage determined in advance, the other one of said terminals of said capacitor is connected to the gate electrode of said device driving transistor through a second node, a specific one of said terminals of said first switch circuit is connected to said second node, and the other one of said terminals of said first switch circuit is connected to the other one of said source and drain areas of said device driving transistor, and a second-node electric-potential correction process is carried out in order to change an electric potential appearing on said second node by applying a voltage having a magnitude determined in advance to said first node for a time period determined in advance with said first switch circuit already put in a turned-on state in order to put said second node in a state of being electrically connected to said other one of said source and drain areas of said device driving transistor.

11. The display apparatus in according to claim 10, wherein said light emitting device is an organic electro luminescence light emitting device.

12. The display apparatus in accordance with claim 10, wherein a signal writing process changes an electric potential appearing on said second node toward an electric potential, which is obtained as a result of subtracting the threshold voltage of said device driving transistor from the voltage of a video signal appearing on one of said data lines, by applying said video signal to said first node by way of said signal writing transistor which is put in a turned-on state by a signal appearing on one of said scan lines when said first switch circuit is put in a turned-on state in order to put said second node in a state of being electrically connected to said other one of said source and drain areas of said device driving transistor, and wherein after said signal writing process has been completed, said second-node electric-potential correction process is carried out.

13. The display apparatus in accordance with claim 12, wherein, prior to said signal writing process, a second-node electric-potential initialization process is carried out in order to set said electric potential appearing on said second node at a reference electric potential determined in advance.

14. The display apparatus in accordance with claim 10, wherein a light emission process of driving said light emitting device allows a driving current generated by said device driving transistor to flow to said light emitting device through application of a driving voltage determined in advance to said first node, and said light emission process is carried out after completion of said second-node electric-potential correction process.

15. The display apparatus in accordance with claim 14, wherein said driving voltage is applied to said first node as said voltage having a magnitude determined in advance during said second-node electric-potential correction process.

16. The display apparatus in accordance with claim 10, wherein said driving circuit provided for each of said light emitting units employed in said display apparatus further includes a second switch circuit connected between said second node and a power-supply line conveying an initialization voltage determined in advance, a third switch circuit connected between said first node and another power-supply line conveying a driving voltage, and a fourth switch circuit connected between said other one of said source and drain areas of said device driving transistor and a specific one of the electrodes of said light emitting unit, and wherein:

a second-node electric-potential initialization process sustains each of said first, third and fourth switch circuits in a turned-off state and applies said predetermined initialization voltage appearing on said power-supply line to said second node by way of said second switch circuit put in a turned-on state and, then, puts said second switch circuit in a turned-off state in order to set an electric potential appearing on said second node at a reference electric potential determined in advance as said initialization voltage;

a signal writing process sustains each of said second, third and fourth switch circuits in a turned-off state and puts said first switch circuit in a turned-on state to put said second node in a state of being electrically connected to said other one of said source and drain areas of said device driving transistor so as to apply a video signal appearing on one of said data lines to said first node by way of said signal writing transistor put in a turned-on state by a signal appearing on one of said scan lines in order to change an electric potential appearing on said second node toward an electric potential obtained as a result of subtracting said threshold voltage of said device driving transistor from said video signal;

a signal asserted on one of said scan lines is applied to said gate electrode of said signal writing transistor later on in order to put said signal writing transistor in a turned-off state; and a light emission process puts said first switch circuit in a turned-off state, sustains said second switch circuit in a turned-off state, applies said driving voltage determined in advance to said first node by way of said third switch circuit which has already been put in a turned-on state, puts said other one of said source and drain areas of said device driving transistor in a state of being electrically connected to said specific one of said electrodes of said light emitting device by way of said fourth transistor put in a turned-on state later on in order to allow a driving current to flow from said device driving transistor to said light emitting device, wherein, between asserting said signal and said light emission process, said second-node electric-potential correction process is carried out by applying said driving voltage as a voltage with a magnitude determined in advance for a period determined in advance to said first node with said first switch circuit sustained at a turned-on state and said third switch circuit put in a turned-on state.

17. The display apparatus in accordance with claim 16, wherein said second switch circuit employed in said driving circuit of said light emitting unit provided for the mth matrix row associated with said scan line $SCL_m$, is controlled by a scan signal asserted on a scan line $SCL_{m_pre_P}$ provided for a matrix row preceding said mth matrix row by P matrix rows where suffix or notation m denotes an integer having a value of 1, 2, . . . or M, and notation P is an integer determined in advance for said display apparatus as an integer satisfying the relation of $1<P<M$.

18. The display apparatus in accordance with claim 17, wherein said integer P is set as 1.

* * * * *